US009174436B2

(12) United States Patent
Suzuki et al.

(10) Patent No.: US 9,174,436 B2
(45) Date of Patent: Nov. 3, 2015

(54) PRINTING APPARATUS AND METHOD OF PROCESSING PRINTING DATA

(71) Applicant: CANON KABUSHIKI KAISHA, Tokyo (JP)

(72) Inventors: Fumiko Suzuki, Kawasaki (JP); Osamu Iwasaki, Tokyo (JP); Atsuhiko Masuyama, Yokohama (JP); Satoshi Masuda, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/557,765

(22) Filed: Dec. 2, 2014

(65) Prior Publication Data

US 2015/0158291 A1 Jun. 11, 2015

(30) Foreign Application Priority Data

Dec. 10, 2013 (JP) ..... 2013-255368

(51) Int. Cl.
*B41J 29/393* (2006.01)
*B41J 2/045* (2006.01)

(52) U.S. Cl.
CPC ..... *B41J 2/04541* (2013.01)

(58) Field of Classification Search
USPC ..... 347/5, 9, 12, 14, 19
See application file for complete search history.

(56) References Cited

U.S. PATENT DOCUMENTS 5,280,310 A 1/1994 Otsuka et al.
5,448,274 A 9/1995 Hirabayashi et al.
5,745,132 A 4/1998 Hirabayashi et al.
5,940,094 A 8/1999 Otsuka et al.
5,943,073 A 8/1999 Otsuka et al.
5,975,673 A 11/1999 Ohtsuka et al.
5,992,971 A 11/1999 Takahashi et al.
6,019,448 A 2/2000 Yano et al.
6,120,129 A 9/2000 Iwasaki et al.
6,142,600 A 11/2000 Takahashi et al.
6,145,950 A 11/2000 Ohtsuka et al.
6,158,836 A 12/2000 Iwasaki et al.
6,244,681 B1 6/2001 Yano et al.
6,257,691 B1 7/2001 Iwasaki et al.
6,260,938 B1 7/2001 Ohtsuka et al.
6,312,096 B1 11/2001 Koitabashi et al.
6,331,039 B1 12/2001 Iwasaki et al.
6,352,327 B1 3/2002 Yano et al.
6,371,592 B1 4/2002 Otsuka et al.
6,390,586 B1 5/2002 Takahashi et al.

(Continued)

FOREIGN PATENT DOCUMENTS

JP 2009-6676 A 1/2009

*Primary Examiner* — Lam Nguyen
(74) *Attorney, Agent, or Firm* — Fitzpatrick, Cella, Harper & Scinto

(57) ABSTRACT

A printing apparatus, comprising a driving unit for driving a printhead including a plurality of nozzles each of which prints a dot, a conveying unit for conveying a printing medium, a memory and a unit, wherein the plurality of nozzles are arranged to form nozzle arrays adjacent to each other, the unit performs a first operation for developing printing data column by column on the memory, a second operation for assigning the printing data to each nozzle array, and a third operation for controlling the driving unit based on the assigned printing data, and, after the first operation and before the second operation, the unit specifies a portion of the printing data corresponding to a dot deviated from a correct printing region due to a tilt of the nozzle arrays and rearranges the portion.

9 Claims, 33 Drawing Sheets

(56) References Cited

U.S. PATENT DOCUMENTS

| | | | |
|---|---|---|---|
| 6,394,571 | B1 | 5/2002 | Yano et al. |
| 6,488,350 | B2 | 12/2002 | Iwasaki et al. |
| 6,764,154 | B2 | 7/2004 | Nishikori et al. |
| 6,808,247 | B2 | 10/2004 | Kawatoko et al. |
| 6,846,066 | B2 | 1/2005 | Teshikawara et al. |
| 6,877,833 | B2 | 4/2005 | Teshigawara et al. |
| 6,899,413 | B2 | 5/2005 | Otsuka et al. |
| 6,935,737 | B2 | 8/2005 | Kanome et al. |
| 6,957,880 | B2 | 10/2005 | Kawatoko et al. |
| 6,991,316 | B2 | 1/2006 | Maru et al. |
| 7,057,756 | B2 | 6/2006 | Ogasahara et al. |
| 7,090,332 | B2 | 8/2006 | Konno et al. |
| 7,114,790 | B2 | 10/2006 | Seki et al. |
| 7,258,412 | B2 | 8/2007 | Maru et al. |
| 7,261,387 | B2 | 8/2007 | Nishikori et al. |
| 7,287,830 | B2 | 10/2007 | Ide et al. |
| 7,303,247 | B2 | 12/2007 | Maru et al. |
| 7,328,963 | B2 | 2/2008 | Tajika et al. |
| 7,354,133 | B2 | 4/2008 | Ide et al. |
| 7,408,676 | B2 | 8/2008 | Yazawa et al. |
| 7,410,239 | B2 | 8/2008 | Takahashi et al. |
| 7,461,932 | B2 | 12/2008 | Iwasaki et al. |
| 7,515,318 | B2 | 4/2009 | Nishikori et al. |
| 7,533,952 | B2 * | 5/2009 | Otokita ..... 347/14 |
| 7,533,962 | B2 | 5/2009 | Masuyama et al. |
| 7,537,661 | B2 | 5/2009 | Nakagawa et al. |
| 7,591,545 | B2 | 9/2009 | Iwasaki et al. |
| 7,604,344 | B2 | 10/2009 | Seki et al. |
| 7,614,714 | B2 | 11/2009 | Masuyama et al. |
| 7,651,194 | B2 | 1/2010 | Yazawa et al. |
| 7,669,989 | B2 | 3/2010 | Oshio et al. |
| 7,891,796 | B2 | 2/2011 | Masuyama et al. |
| 7,959,246 | B2 | 6/2011 | Hamasaki et al. |
| 7,963,245 | B2 | 6/2011 | Oshio et al. |
| 7,980,672 | B2 | 7/2011 | Umezawa et al. |
| 8,001,921 | B2 | 8/2011 | Oshio et al. |
| 8,186,789 | B2 | 5/2012 | Aono et al. |
| 8,201,907 | B2 | 6/2012 | Teshigawara et al. |
| 8,251,473 | B2 | 8/2012 | Moriyama et al. |
| 8,727,526 | B2 | 5/2014 | Yamamoto et al. |
| 8,740,345 | B2 | 6/2014 | Masuda |
| 8,955,956 | B2 | 2/2015 | Yamamoto et al. |
| 2004/0233246 | A1 * | 11/2004 | Takeushi ..... 347/19 |
| 2012/0287191 | A1 | 11/2012 | Nishikori et al. |
| 2012/0287193 | A1 | 11/2012 | Suzuki et al. |
| 2012/0287194 | A1 | 11/2012 | Masuda et al. |
| 2014/0104335 | A1 | 4/2014 | Kawatoko et al. |

* cited by examiner

FIG. 8

| | SELECTED BLOCK | |
|---|---|---|
| DRIVING ORDER | NOZZLE ARRAY Nzl-A | NOZZLE ARRAY Nzl-B |
| 0 | 0 | 8 |
| 1 | 1 | 9 |
| 2 | 2 | 10 |
| 3 | 3 | 11 |
| 4 | 4 | 12 |
| 5 | 5 | 13 |
| 6 | 6 | 14 |
| 7 | 7 | 15 |
| 8 | 8 | 0 |
| 9 | 9 | 1 |
| 10 | 10 | 2 |
| 11 | 11 | 3 |
| 12 | 12 | 4 |
| 13 | 13 | 5 |
| 14 | 14 | 6 |
| 15 | 15 | 7 |

FIG. 13

| | Seg# | CORRECTION VALUE |
|---|---|---|
| $G_0$ | 0~15 | 0 |
| $G_1$ | 16~31 | 2 |
| $G_2$ | 32~47 | 4 |
| $G_3$ | 48~63 | 6 |
| $G_4$ | 64~79 | 8 |
| $G_5$ | 80~95 | 10 |
| $G_6$ | 96~111 | 12 |
| $G_7$ | 112~127 | 14 |

Clm0
Clm1
Clm2
Clm3
B#0
B#1
B#2
B#3
B#4
B#5
B#6
B#7
B#8
B#9
B#10
B#11
B#12
B#13
B#14
B#15
Nzl-A
NA_ Clm0
NA_ Clm2
NA' Clm0
NA' Clm2
NA' Clm4
Nzl-B
NB_ Clm1
NB_ Clm3
NB' Clm1
NB' Clm3
NB' Clm5
Null
Next NzI-A
NzI-B
NA' Clm0̄1
NA' Clm2̄3
NA' Clm4̄5
NB' Clm1̄0
NB' Clm3̄2
NB' Clm5̄4
I' Clm0̄
I' Clm1̄
I' Clm2̄
I' Clm3̄
I' Clm4̄
I' Clm5̄
B#0
B#1
B#2
B#3
B#4
B#5
B#6
B#7
B#8
B#9
B#10
B#11
B#12
B#13
B#14
B#15
Null
Next

FIG. 21

| | SELECTED BLOCK | |
|---|---|---|
| DRIVING ORDER | NOZZLE ARRAY Nzl-A | NOZZLE ARRAY Nzl-B |
| 0 | 0 | 4 |
| 1 | 8 | 12 |
| 2 | 5 | 1 |
| 3 | 13 | 9 |
| 4 | 2 | 6 |
| 5 | 10 | 14 |
| 6 | 7 | 3 |
| 7 | 15 | 11 |
| 8 | 4 | 0 |
| 9 | 12 | 8 |
| 10 | 1 | 5 |
| 11 | 9 | 13 |
| 12 | 6 | 2 |
| 13 | 14 | 10 |
| 14 | 3 | 7 |
| 15 | 11 | 15 |

NzI-A
NzI-B
Null
Next

Nzl-A
Nzl-B
Null
Next
B#0
B#1
B#2
B#3
B#4
B#5
B#6
B#7
B#8
B#9
B#10
B#11
B#12
B#13
B#14
B#15

FIG. 27

| | SELECTED BLOCK | | | |
|---|---|---|---|---|
| DRIVING ORDER | NOZZLE ARRAY Nzl-A | NOZZLE ARRAY Nzl-B | NOZZLE ARRAY Nzl-C | NOZZLE ARRAY Nzl-D |
| 0 | 0 | 8 | 4 | 12 |
| 1 | 1 | 9 | 5 | 13 |
| 2 | 2 | 10 | 6 | 14 |
| 3 | 3 | 11 | 7 | 15 |
| 4 | 4 | 12 | 8 | 0 |
| 5 | 5 | 13 | 9 | 1 |
| 6 | 6 | 14 | 10 | 2 |
| 7 | 7 | 15 | 11 | 3 |
| 8 | 8 | 0 | 12 | 4 |
| 9 | 9 | 1 | 13 | 5 |
| 10 | 10 | 2 | 14 | 6 |
| 11 | 11 | 3 | 15 | 7 |
| 12 | 12 | 4 | 0 | 8 |
| 13 | 13 | 5 | 1 | 9 |
| 14 | 14 | 6 | 2 | 10 |
| 15 | 15 | 7 | 3 | 11 |

Nzl-A
Nzl-B
Null
Next

PRINTING APPARATUS AND METHOD OF PROCESSING PRINTING DATA

BACKGROUND OF THE INVENTION

1. Field of the Invention

The present invention relates to a printing apparatus and a method of processing printing data.

2. Description of the Related Art

A printing apparatus includes a printhead in which a plurality of nozzles (ink orifices) are arranged, and performs printing by alternately performing an operation of printing a dot by each nozzle while scanning the printhead on a printing medium, and an operation of conveying the printing medium. Dot printing is performed by driving printing elements formed in one-to-one correspondence with the nozzles. Note that the scanning direction of the printhead is called a "main scanning direction", the conveyance direction of the printing medium is called a "sub scanning direction", and the two directions intersect each other.

FIG. 31 is a schematic view exemplarily showing dots d printed on a printing medium P when printing is performed by a time-divisional driving method by using a printhead H. Note that the time-divisional driving method is a driving method of performing printing by dividing a plurality of printing elements corresponding to a plurality of nozzles nz into, for example, N groups G ($G_0$ to $G_{N-1}$), and sequentially driving the printing elements of each group G one by one. Note that printing elements to be driven at the same time in the groups $G_0$ to $G_{N-1}$ are classified as a "block", and 16 blocks B (B#0 to B#15) exist in the example shown in FIG. 31.

As shown in FIG. 31, an image based on printing data input to the printing apparatus is formed by a plurality of dots d printed in each column on the printing medium P. More specifically, the printing data input to the printing apparatus is first developed (expanded) so that a plurality of printing elements can be driven in a predetermined order. After that, each printing element is driven based on the developed printing data, and the nozzle nz corresponding to the printing element discharges ink (a printing agent), thereby printing the dot d for forming an image in a corresponding column on the printing medium P.

If the direction in which the plurality of nozzles nz are arranged has a tilt with respect to the sub scanning direction, this tilt produces a shift of a printing position (a shift from the intended position of the dot d). That is, the dot d to be printed in a given column is printed in a position (for example, an adjacent column) deviated from the given column due to the tilt. This will be explained with reference to FIG. 32.

FIG. 32 is a schematic view showing, in the same manner as in FIG. 31, a printhead H having a nozzle array whose arrangement direction has a tilt with respect to the sub scanning direction, and dots d printed when printing is performed by using the printhead H. For example, of the dots printed by nozzles nz of a group $G_2$, two dots on the downstream side in the conveyance direction of a printing medium P are intended to be printed in column 0 but are printed on the left side of column 0 due to the tilt of the nozzle array. A shift of the printing position like this may decrease the image quality.

Japanese Patent Laid-Open No. 2009-6676 has disclosed a technique which, when the direction in which a nozzle array is arranged has a tilt with respect to the sub scanning direction, acquires the tilt amount based on a test pattern formed by the nozzle array, and corrects a shift of the printing position in accordance with the tilt amount. According to Japanese Patent Laid-Open No. 2009-6676, this correction is performed by changing, in accordance with the above-mentioned tilt amount, the read position of printing data stored in each address of a memory (storage means) in association with each column on a printing medium. Consequently, a dot is printed in an intended column instead of an adjacent column.

As a printing method advantageous in increasing the printing speed or improving the image quality, there is a method in which a printhead has two or more nozzle arrays which discharge ink of the same color, and printing is performed by using these nozzle arrays in order. For example, when the printhead has two nozzle arrays, dots adjacent to each other in the main scanning direction are printed by alternately using the two nozzle arrays. Japanese Patent Laid-Open No. 2009-6676 does not take account of a method of correcting a shift of the printing position in this printing method.

SUMMARY OF THE INVENTION

The present invention provides a technique advantageous in correcting a shift of the printing position when the arrangement direction of two or more nozzle arrays has a tilt with respect to the sub scanning direction.

One of the aspects of the present invention provides a printing apparatus, comprising a driving unit configured to drive a printhead including a plurality of nozzles formed into an array in a predetermined direction such that each nozzle of the printhead forms a dot on a printing medium, while scanning the printhead in a first direction intersecting the predetermined direction with respect to the printing medium, wherein the plurality of nozzles are arranged such that nozzles for printing dots of the same color form two or more nozzle arrays adjacent to each other in the first direction, a memory configured to store printing data, a data processing unit configured to perform a first operation for developing printing data column by column on the memory, and a second operation for assigning the printing data on the memory to each nozzle array, and a controlling unit configured to control the driving unit to print dots on the printing medium by using the nozzles of each nozzle array, based on the assigned printing data, wherein the data processing unit further performs, after the first operation and before the second operation, an operation for specifying, in a case where printing is performed by assigning, to each nozzle array, the printing data of each column developed on the memory in the first operation, a portion of the printing data, which corresponds to a dot whose printing position is deviated from a region corresponding to the column of the printing data due to a tilt of the two or more nozzle arrays with respect to a direction perpendicular to the first direction, based on the tilt of the two or more nozzle arrays, and an operation for changing, on the memory, the printing data developed on the memory, such that the specified portion is shifted by a column corresponding to the tilt of the two or more nozzle arrays.

Further features of the present invention will become apparent from the following description of exemplary embodiments with reference to the attached drawings.

BRIEF DESCRIPTION OF THE DRAWINGS

FIG. 8 is a view for explaining an example of a nozzle use order when performing printing;

FIG. 13 is a view for explaining an example of correction information corresponding to a tilt of a nozzle array;

FIG. 21 is a view for explaining an example of the nozzle use order when performing printing;

FIGS. 24A1 to 24A5 and 24B1 to 24B5 are views for explaining examples of mask data for processing printing data;

FIG. 27 is a view for explaining an example of the nozzle use order when performing printing;

FIGS. 29A1 to 29A3, 29B1, and 29B2 are views for explaining an example of the printing data processing method;

DESCRIPTION OF THE EMBODIMENTS

1. Arrangement Example of Printing Apparatus

An arrangement example of an inkjet printing apparatus PA will be explained with reference to FIGS. 1 and 2.

Figure 1:
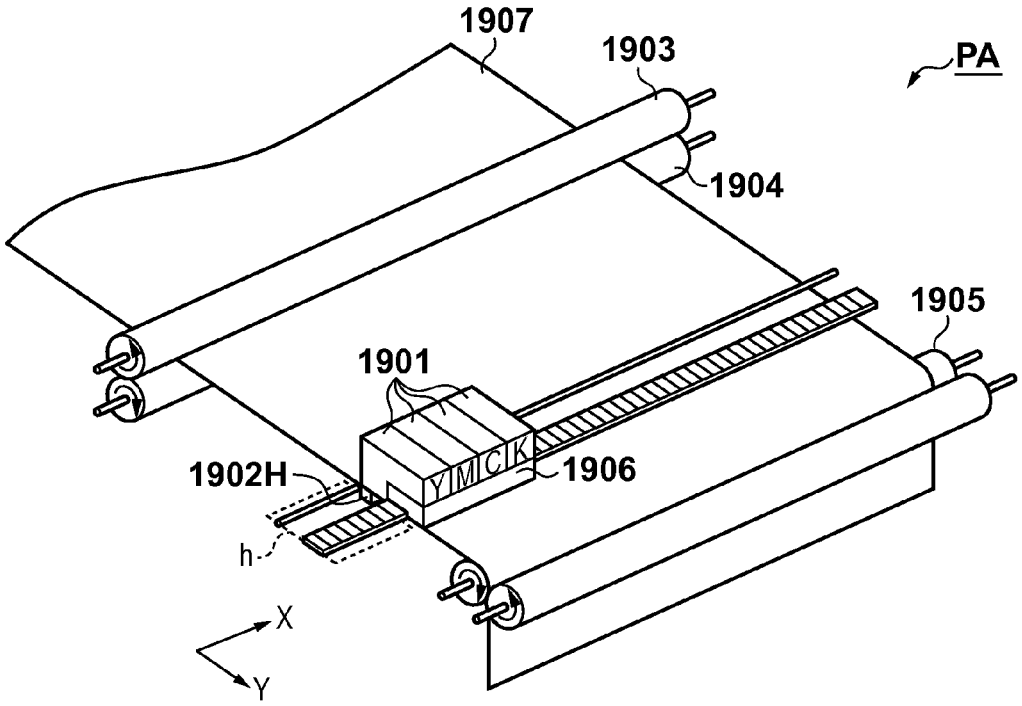
FIG. 1 a view for explaining a portion of an arrangement example of a printing apparatus.

FIG. 1 is a schematic view showing an example of a portion (mainly a portion of performing a printing operation) of the arrangement of the printing apparatus PA. The printing apparatus PA conveys a printing medium 1907 such as a printing sheet in the Y direction while scanning a printhead 1902H in the X direction. The X direction is also called a "main scanning direction", the Y direction is also called a "sub scanning direction", and the two directions intersect each other.

The printhead 1902H includes a plurality of ink tanks 1901. Ink having a corresponding color is filled in each ink tank 1901, and supplied to the printhead 1902H. FIG. 1 shows four ink tanks 1901, and yellow (Y), magenta (M), cyan (C), and black (K) inks are filled in the four ink tanks 1901. The ink tanks 1901 are individually detachable, and each ink tank 1901 can be replaced with another ink tank when the ink is used up or the remaining ink amount becomes small.

Note that the arrangement in which the printhead and ink tanks can be separated is exemplified in this embodiment, but the present invention is not limited to this. For example, it is also possible to adopt an arrangement in which a printhead and ink tanks are integrated and replaceable at once.

A plurality of nozzles (ink orifices) for discharging the inks of different colors are so arranged as to form one or more arrays on the surface of the printhead 1902H, which is used to perform printing. Also, a plurality of printing elements are arranged in the printhead 1902H in one-to-one correspondence with the plurality of nozzles. In response to driving of each printing element, a corresponding nozzle discharges ink onto the printing medium 1907. The printhead 1902H generally includes a printhead substrate on which a plurality of printing elements are arranged.

The plurality of ink tanks 1901 and the printhead 1902H are supported by and fixed to a carriage 1906. When the printing apparatus PA performs printing, each printing element is driven based on printing data input to the printing apparatus PA, while the carriage 1906 moves back and forth in the X direction. Note that when the printing apparatus PA is in a pause mode or a printhead recovery process such as preliminary discharging is performed, the carriage 1906 and printhead 1902H are waiting in a home position h indicated by the broken lines in FIG. 1.

The printing medium 1907 is clamped between rollers 1903 to 1905 (conveying parts) such as feed rollers, and conveyed in the Y direction when the rollers 1903 to 1905 rotate. Note that the conveying mechanism of the printing medium 1907 is not limited to the arrangement exemplified in this embodiment, and another arrangement may also be adopted. For example, a decurl unit for adjusting a curl of the printing medium 1907 may also be formed.

The printing apparatus PA performs printing by using the arrangement as described above. More specifically, a printing operation is started in response to a print job containing printing data, and an operation of scanning the printhead 1902H with respect to the printing medium 1907 and an operation of conveying the printing medium 1907 are alternately performed.

While the printhead 1902H is scanned, each nozzle discharges ink onto the printing medium 1907. More specifically, the ink discharged from each nozzle prints a plurality of dots forming an image, character, or the like based on the printing data on the printing medium 1907.

Note that this printing may be performed while the printhead 1902H is scanned in only one direction (for example, the +X direction), and may also be performed while the printhead 1902H is scanned in two directions (the −X and +X directions). In this specification, a mode in which printing is performed while the printhead 1902H is scanned in one direction (the +X direction) will be explained in order to facilitate the explanation.

Figure 2:
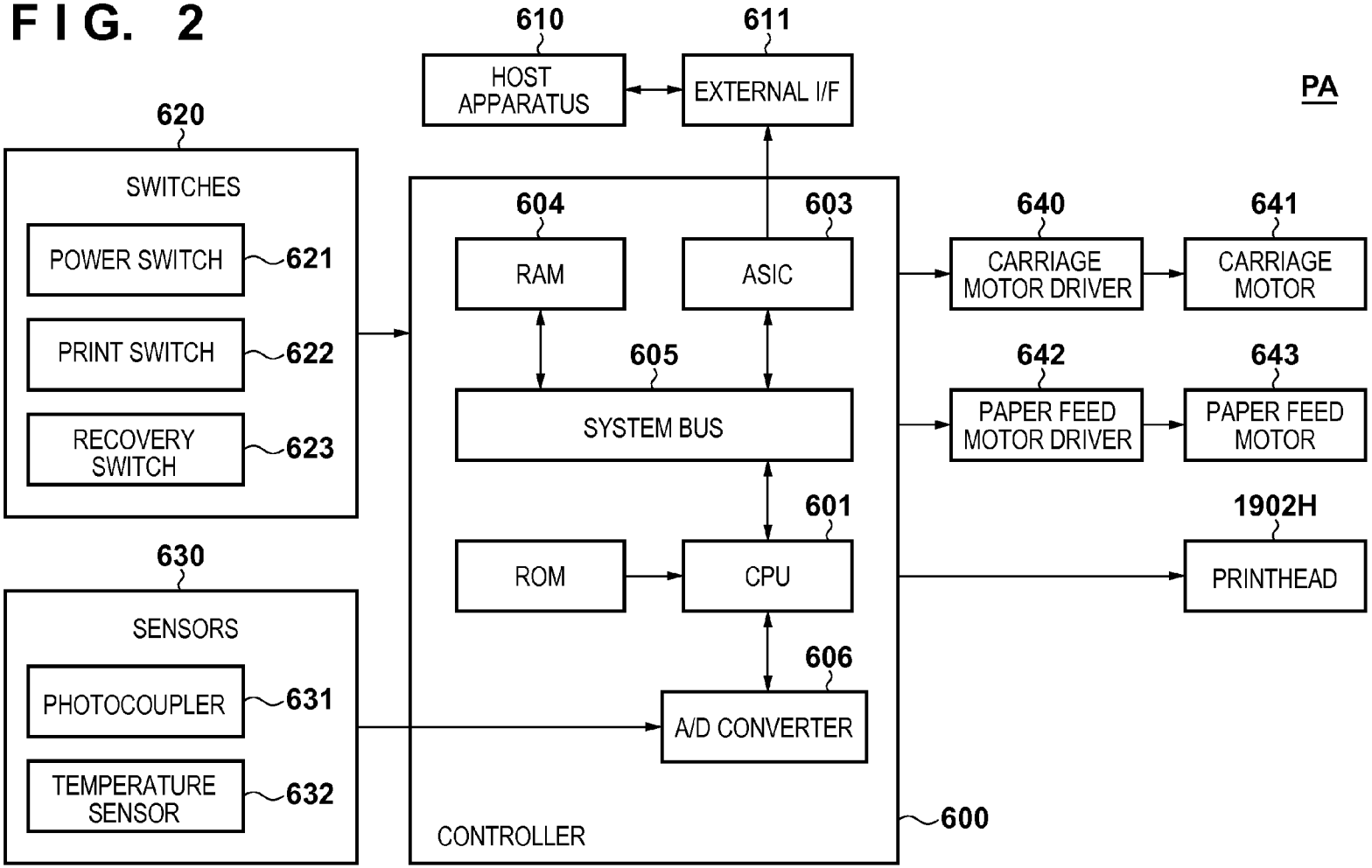
FIG. 2 is a view for explaining a system configuration example of the printing apparatus.

FIG. 2 is a block diagram showing a system configuration example of the printing apparatus PA. The printing apparatus PA includes, for example, a controller 600, switches 620, sensors 630, and a plurality of drivers 640 and 642 for driving the above-described units.

The controller 600 includes a CPU 601, ROM 602, ASIC 603, RAM 604, system bus 605, and analog-digital converter 606 (A/D converter 606). The CPU 601 is a processor for performing arithmetic processing such as data processing for allowing the printing apparatus PA to perform a printing operation, based on, for example, an external input signal or setting information. The ROM 602 is a memory unit storing, for example, programs for performing predetermined sequence control and procedures (to be described later), a table (lookup table) for looking up necessary information, and intrinsic data determined by the printing apparatus PA. The ASIC 603 is an integrated circuit which generates control signals for controlling the printhead 1902H, a carriage motor (to be described later), and the like. The RAM 604 is a work area necessary for the CPU 601 or the like to perform predetermined data processing. For example, the RAM 604 is a memory unit in which printing data (or image data) can be developed and temporarily be stored. The system bus 605 interconnects the CPU 601, ASIC 603, and RAM 604, and allows these units to exchange data with each other. The A/D converter 606 receives a signal (analog signal) from the sensors 630, performs A/D conversion on the received signal, and outputs a digital signal corresponding to the analog signal to the CPU 601.

Also, the controller 600 is connected to an external host computer 610 via an external interface (external I/F) 611, and receives, for example, a print job containing printing data, a control command, and the like, and setting information necessary for a printing operation, from the host computer 610. Furthermore, the controller 600 outputs information necessary for the user, for example, the state of the printing apparatus PA, to the host computer 610.

The switches 620 include, for example, a power switch 621 for supplying a power supply voltage to the printing apparatus PA, a print switch 622 for designating the start of printing, and a recovery switch 623 for designating the start of a recovery process of the printhead 1902H. The switches 620 may also include one or more switches for receiving various instructions from the user.

The sensors 630 include, for example, a photocoupler 631 for detecting the above-described home position h, and a temperature sensor 632 for detecting the temperature of (the external environment of) the printing apparatus PA. Note that it is also possible to install two or more temperature sensors 632. In this case, the temperature sensors 632 can be installed in two or more different portions of the printing apparatus PA.

The carriage motor driver 640 drives a carriage motor 641 when receiving a control signal from the controller 600, thereby moving the carriage 1906. The paper-feed motor driver 642 drives a paper-feed motor 643 when receiving a control signal from the controller 600, thereby rotating the above-described rollers 1903 to 1905, and conveying the printing medium 1907. The printing apparatus PA further includes other drivers (not shown), and drives the printing elements by using these drivers while scanning the printhead 1902H.

2. Arrangement Example and Operation Example of Printhead Substrate

An arrangement example and operation example of a printhead substrate HS on which a plurality of printing elements are arranged will be explained with reference to FIGS. 3 to 6.

2.1. Arrangement Example of Printhead Substrate

Figure 3:
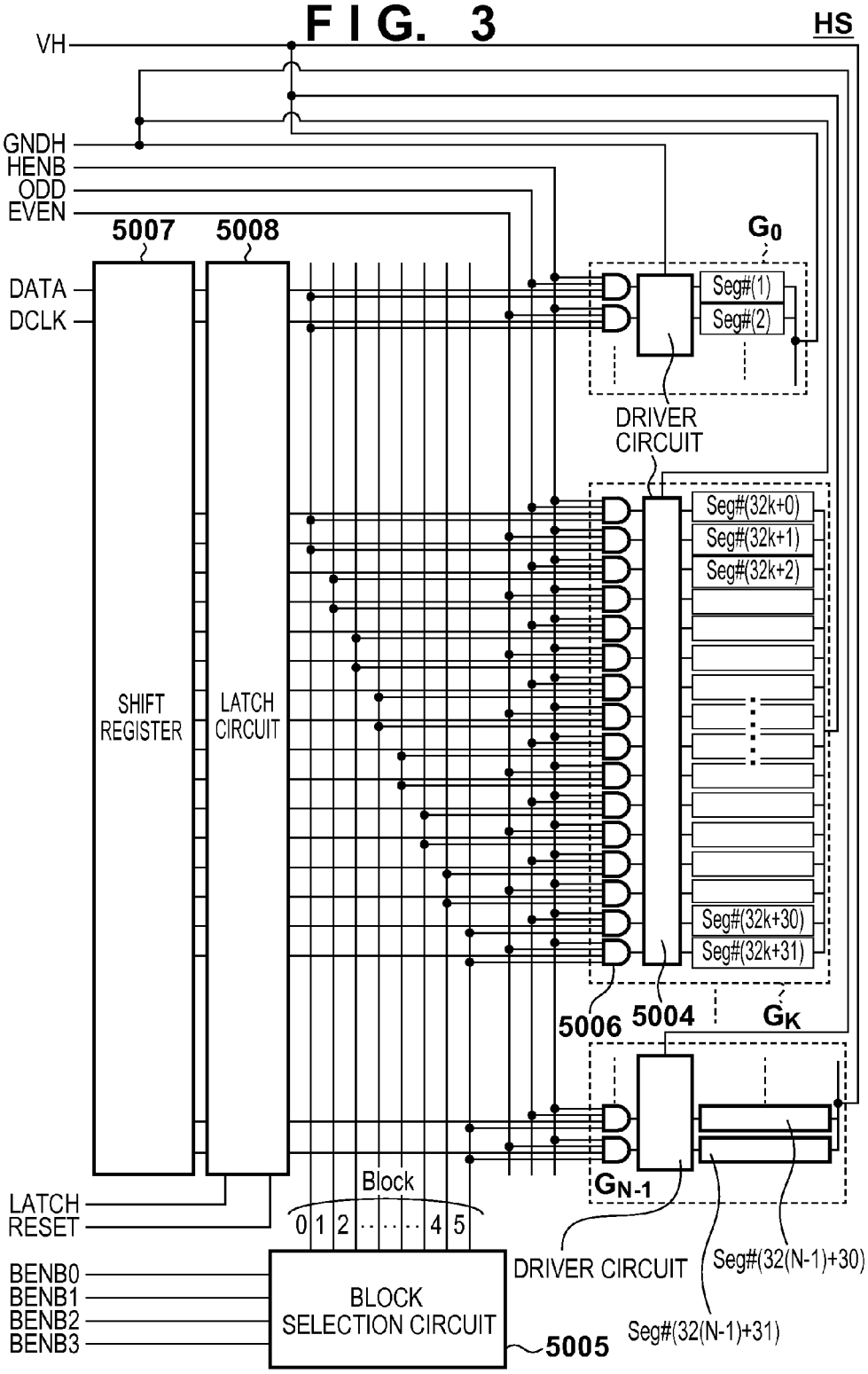
FIG. 3 is a view for explaining an arrangement example of a printhead substrate.

As exemplarily shown in FIG. 3, the printhead substrate HS includes N groups $G_0$ to $G_{N-1}$ (N is an integer of 2 or more), a shift register 5007, a latch circuit 5008, and a block selection circuit 5005.

Each of the N groups $G_k$ (k is an integer of 0 to N−1) includes 32 printing elements, that is, a total of 32×N printing elements are arranged (printing element arrays) on the printhead substrate HS. It is possible to use, for example, a heater (thermoelectric conversion element) as the printing element. Also, each group $G_k$ further includes a driver circuit 5004 for driving these printing elements, and AND circuits 5006 which receive printing data or a control signal and output signals for driving the printing elements to the driver circuit 5004.

The plurality of printing elements can be driven by a so-called, time-divisional driving method. More specifically, the plurality of printing elements can be controlled such that they are sequentially driven one by one in each group $G_k$ (such that two or more printing elements are not driven in one group). This printing method can reduce the influence exerted on the printing characteristics by an uneven heat distribution which can occur when the printing elements are driven.

Since this driving method is adopted, the plurality of printing elements can be given, for example, segment numbers and block numbers for convenience. For example, 32 printing elements of the group $G_k$ are given segment numbers "Seg#(32k+0)" to "Seg#(32k+31)". In addition, the 32 printing elements are assigned two by two to 16 kinds of blocks, and given block numbers "B#0" to "B#15". Note that the nozzles of the printhead 1902H are formed in one-to-one correspondence with the printing elements as described previously, and are given segment numbers and block numbers in the same manner as above.

The shift register 5007 is a 32×N-bit shift register. The controller 600 outputs, for example, an image signal DATA based on printing data and a clock signal DCLK as a reference signal to the shift register 5007. The shift register 5007 receives the image signal DATA from the controller 600 by, for example, serial communication, and holds the image signal DATA in accordance with the clock signal DCLK.

The latch circuit 5008 is a 32×N-bit latch circuit. The latch circuit 5008 receives, for example, a latch signal LATCH from the controller 600, and latches the image signal DATA held by the shift register 5007. The latched image signal is 1-bit data for determining (or selecting) whether to drive a corresponding printing element (whether to discharge ink from a corresponding nozzle). In this embodiment, this data will simply be referred to as "latch data".

The block selection circuit 5005 has a decoding function. The block selection circuit 5005 receives 4 bit block selection signals BENB (BENB0 to BENB3) from the controller 600, and generates 16 control signals Block (Block0 to Block15). Each of the control signals Block0 to Block15 is input to a corresponding AND circuit 5006 in each group $G_k$. Each control signal Block corresponds to two printing elements in each group $G_k$. More specifically, each control signal Block is input to two AND circuits 5006 corresponding to the two printing elements.

For example, when using the above-described segment numbers, the control signal Block0 corresponds to two printing elements Seg#(32k+0) and Seg#(32k+1), and the control signal Block1 corresponds to two printing elements Seg#(32k+2) and Seg#(32k+3).

This similarly applies to Block2 to Block15. For example, the control signal Block15 corresponds to two printing elements Seg#(32k+30) and Seg#(32k+31).

Although not shown in FIG. 3, a total of 32×N printing elements form two arrays such that pairs of printing elements are arranged into rows, and each pair of printing elements correspond to the above-mentioned two printing elements corresponding to each control signal Block. The two printing elements are individually driven by control signals ODD and EVEN. More specifically, the control signal ODD is input to one of the two AND circuits 5006 corresponding to the two printing elements, and the control signal EVEN is input to the other. For example, letting m be an integer of 0 to 15 in the above-described segment numbers, the control signal ODD corresponds to a printing element Seg#(32k+(2 m+1)), and the control signal EVEN corresponds to a printing element Seg#(32k+2m). Note that m corresponds to the above-described block numbers. The control signals ODD and EVEN are also called "odd-even selection signals".

A reset signal RESET is a control signal for initializing the latch circuit 5008. A heat enable signal HENB is a control signal for determining the driving time of a printing element, and input from the controller 600 to the AND circuits 5006 of the groups $G_0$ to $G_{N-1}$. Also, reference symbol VH denotes a power supply voltage or a power supply node for supplying the power supply voltage, and reference symbol GNDH denotes a power supply node for grounding.

In the above-mentioned arrangement example of the printhead substrate HS, a total of 32×N printing elements are divided into the N groups $G_k$, and 32 printing elements in each group $G_k$ are assigned two by two to 16 kinds of blocks. That is, each of the N groups $G_k$ includes the 16 kinds of blocks, and two printing elements are assigned to each block. N is an integer of 2 or more, and k is an integer of 0 to N−1. One block in each group $G_k$ is selected by the above-described block selection signal, and one of the two printing elements in the selected block is selected by the above-described odd-even selection signal. The selected printing element can be driven based on the above-described latch data and heat enable signal.

2.2. Example of Driving Method of Printhead Substrate

Figure 4:
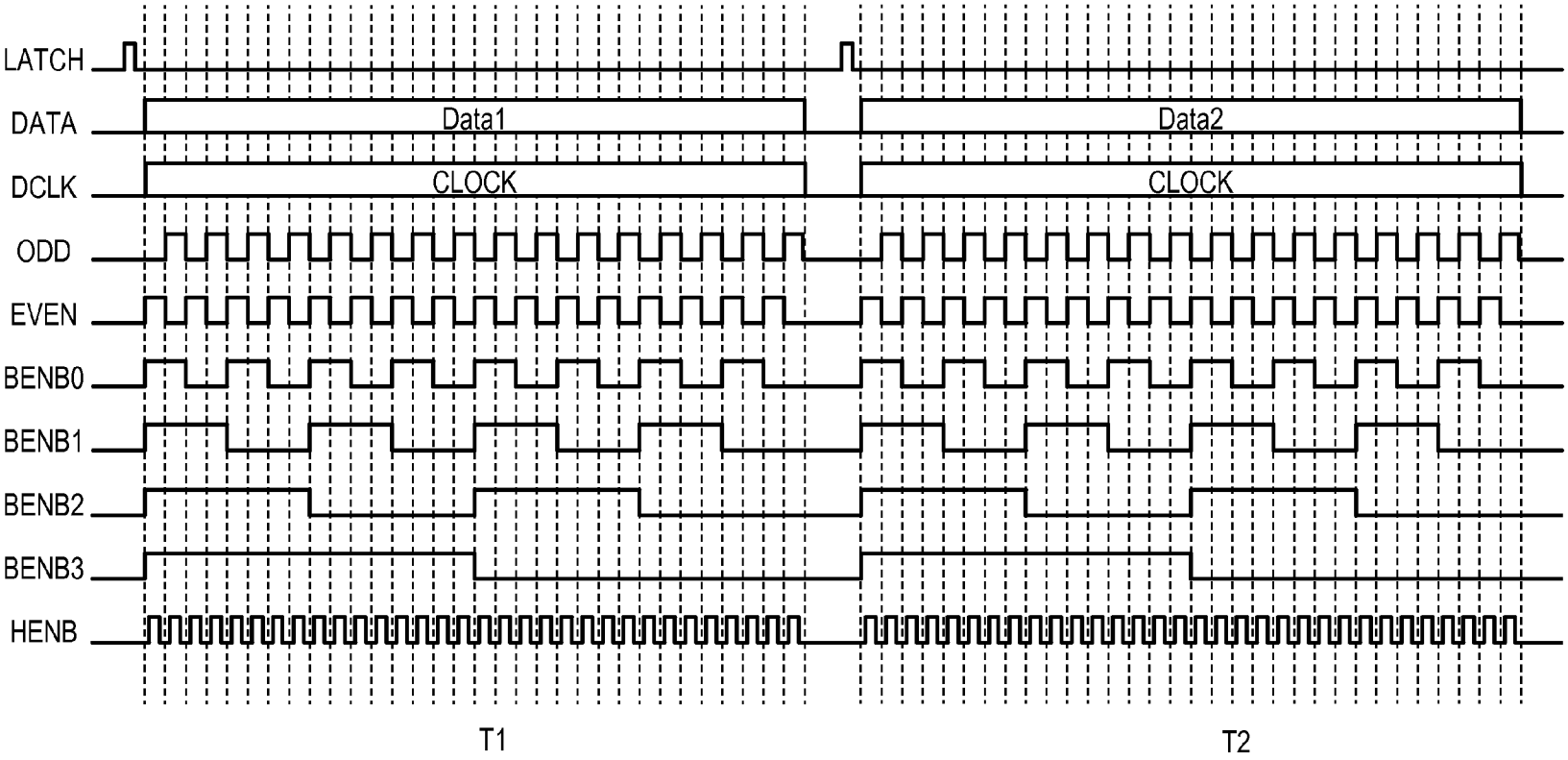
FIG. 4 is a timing chart for explaining an operation example of a printhead.

FIG. 4 is an operation timing chart of the printhead 1902H, and shows signals input to the printhead 1902H by the controller 600. In this embodiment, FIG. 4 is a timing chart corresponding to printing of two periods (periods T1 and T2) when assuming that an operation of driving each of the 32 printing elements in each group $G_k$ once is one period, in order to facilitate the explanation.

The following explanation will be made by using the first period T1, but the same explanation applies to the period T2.

First, the latch signal LATCH is activated, and the latch circuit 5008 latches the image data DATA held by the shift register 5007, thereby obtaining latch data Data1. After that, a printing operation corresponding to latch data Data1 is performed based on the control signals ODD, EVEN, BENB, and the like.

The block selection signals BENB (BENB0 to BENB3) periodically change their signal levels to H or L level, and the periods of the signals BENB1, BENB2, and BENB3 are respectively twofold, fourfold, and eightfold of the period of the signal BENB0. One of the 16 blocks (B#0 to B#15) in each group $G_k$ is selected in accordance with a combination of the signal levels of the block selection signals BENB0 to BENB3. That is, the 16 blocks are sequentially selected one by one during the first period T1.

The signals ODD and EVEN show signal levels different from each other, and these signal levels change to H or L level in a period half that of the signal BENB0. One of the two printing elements of the selected block selected by the block selection signal BENB is selected by the signal ODD or EVEN.

In latched signal Data1, if data corresponding to one printing element selected by the signal BENB and signal ODD or EVEN is "1 (H level)", the printing element is driven over a period corresponding to the pulse width of the heat enable signal HENB. As a consequence, a nozzle corresponding to the printing element discharges ink, thereby printing a dot on the printing medium by the ink droplet. On the other hand, if data corresponding to the printing element is "0 (L level)" in signal Data1, the printing element is not driven (no dot is printed on the printing medium).

Figure 5:
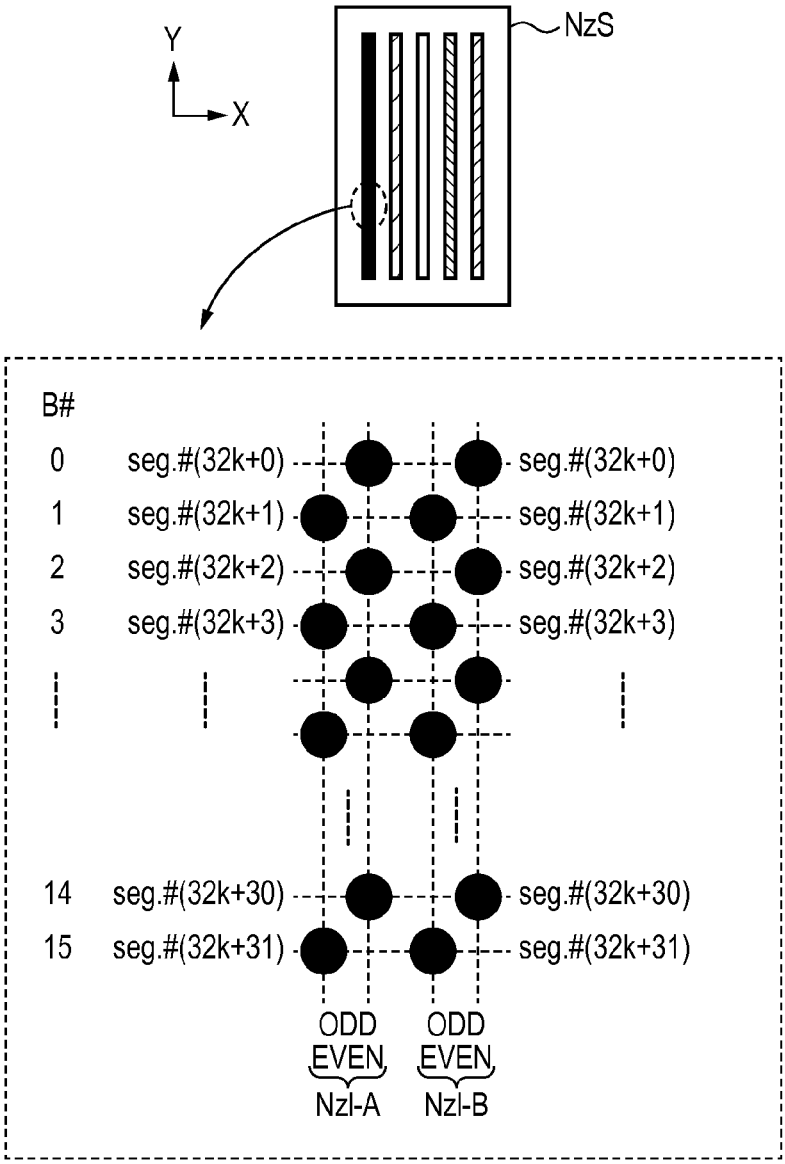
FIG. 5 is a view for explaining an example of a nozzle array in which nozzles are arranged.

FIG. 5 is a schematic view showing a portion of the surface of the printhead 1902H, which is used to perform printing and in which two nozzle arrays are formed for each of four colors (for example, yellow (Y), magenta (M), cyan (C), and black (K) described earlier). This arrangement can be adopted by, for example, attaching a nozzle substrate NzS (an orifice plate) including a plurality of nozzles to the printhead 1902H. In each of the two nozzle arrays, ODD and EVEN nozzles for displaying ink of the same color are alternately arranged in the Y direction (sub scanning direction), and are adjacent to each other in the X direction (main scanning direction). Of the two nozzle arrays, the first array is indicated by "Nzl-A", and the second array is indicated by "Nzl-B". Each nozzle indicated by seg#(32k+(2 m+1)) (m≥0) in the nozzle arrays Nzl-A and Nzl-B corresponds to each printing element selected by the above-described signal ODD, and each nozzle indicated by seg#(32k+2m) (m≥0) in the nozzle arrays Nzl-A and Nzl-B corresponds to each printing element selected by the above-described signal EVEN. Note that each nozzle shown in FIG. 5 is given a corresponding segment number and block number.

Figure 6:
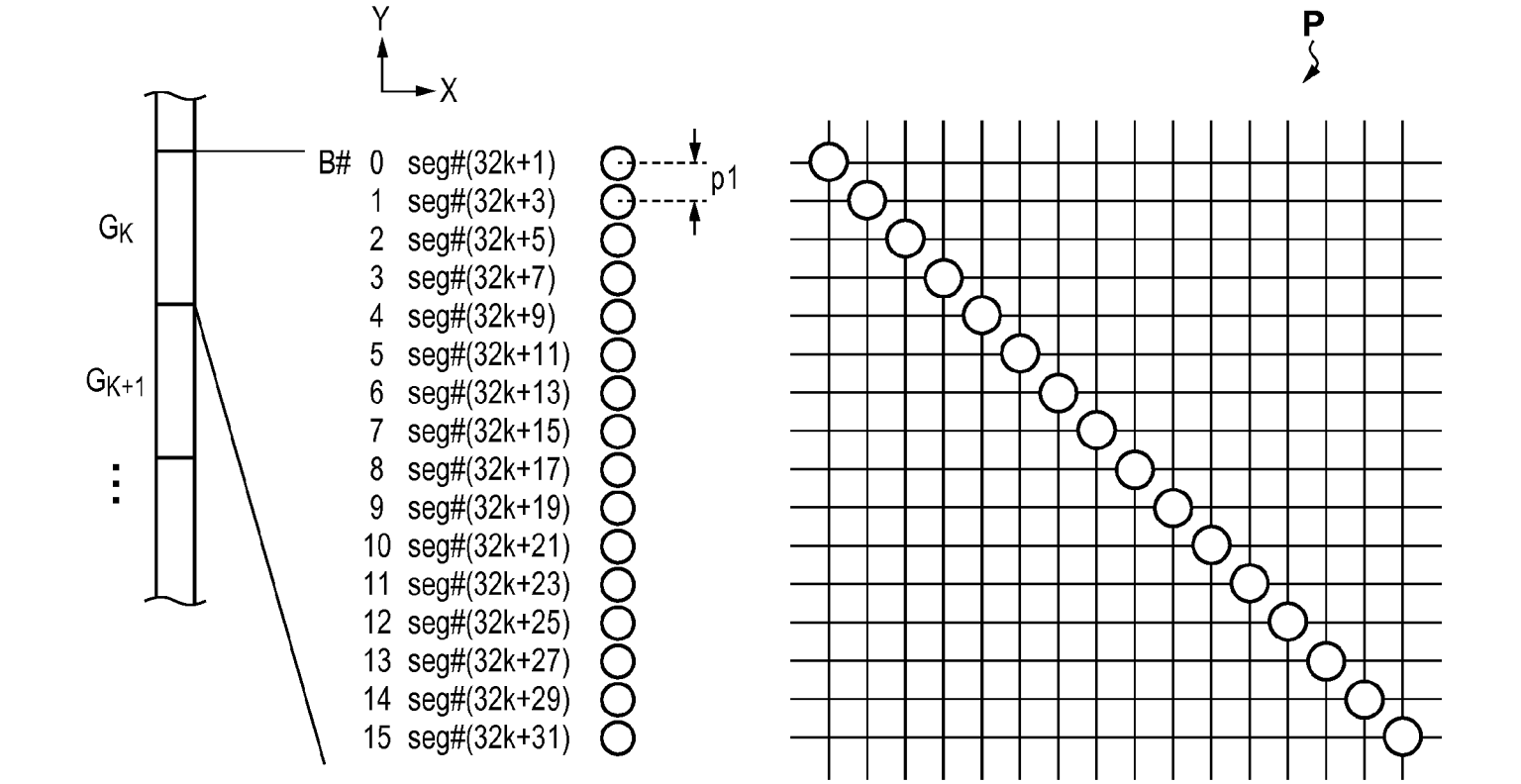
FIG. 6 is a view for explaining dots printed on a printing medium.

FIG. 6 is a schematic view for explaining the positional relationship between each nozzle of the ODD array of the nozzle array Nzl-A, and a dot printed on the printing medium by ink discharged from the nozzle. To facilitate the explanation, a description will be made by focusing on the ODD array of the nozzle array Nzl-A in the group $G_k$. ODD nozzles are arranged at a pitch p1 in the Y direction (sub scanning direction). When performing printing, ink is sequentially discharged from the nozzles while the printhead 1902H moves in the X direction (main scanning direction), thereby printing dots in a corresponding column on the printing medium as shown in FIG. 6.

Note that the case in which the dots are printed in order from the downstream side (the side of Seg#(32k+1)) to the upstream side (the side of Seg#(32k+31)) in the conveyance direction of the printing medium is exemplified in order to facilitate the explanation, but the present invention is not limited to this order. For example, when a nozzle use order (printing element driving order) is predetermined, it is also possible to prepare information (for example, a lookup table)

defining the order, and perform above-described printing in the predetermined order by referring to the information.

2.3. Example of Procedure of Processing Printing Data

An example of a procedure of processing printing data will be explained with reference to FIGS. 7 and 8.

Figure 7:
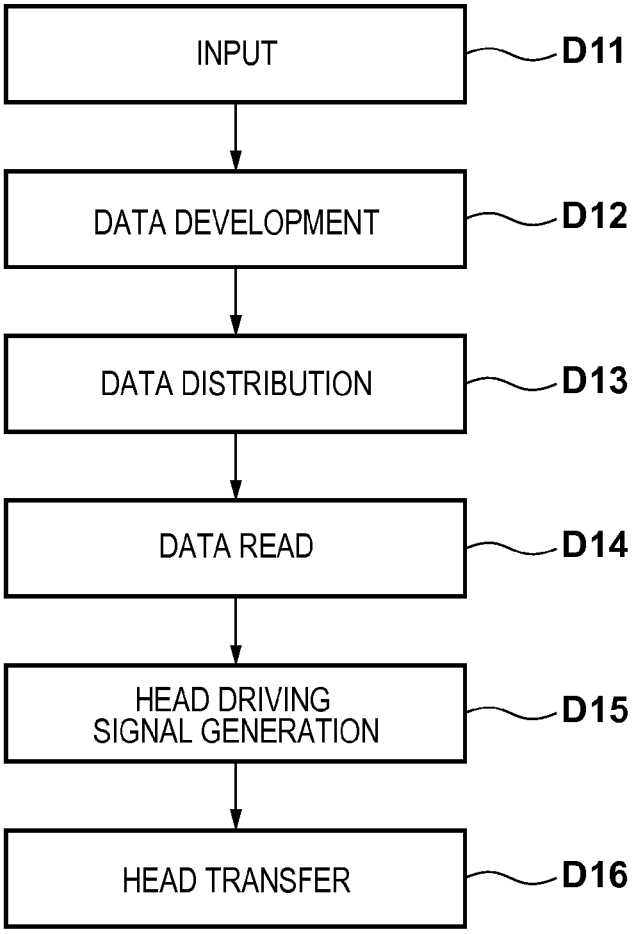
FIG. 7 is a view for explaining an example of a procedure of processing printing data.

FIG. 7 is a view for explaining an outline of the procedure of processing printing data from the input of the printing data to the printing apparatus PA to the output to the printhead 1902H. Printing data (or image data) contained in a print job input to the printing apparatus PA in D11 is developed in each memory of the memory unit such as the RAM 604 in D12. In D13, the developed printing data is distributed to the nozzle arrays in order to sequentially print dots by the nozzles as described above. The printing data distribution method can be predetermined by, for example, a lookup table.

FIG. 8 shows an example of the lookup table defining the use order of the nozzles of the two nozzle arrays Nzl-A and Nzl-B in a selected block. According to this table, dots are initially printed by eight nozzles (a total of sixteen ODD/EVEN nozzles) on the downstream side of the nozzle array Nzl-A, and eight nozzles (a total of sixteen ODD/EVEN nozzles) on the upstream side of the nozzle array Nzl-B. Then, dots are initially printed by eight nozzles (a total of sixteen ODD/EVEN nozzles) on the upstream side of the nozzle array Nzl-A, and eight nozzles (a total of sixteen ODD/EVEN nozzles) on the downstream side of the nozzle array Nzl-B. For example, in D13, the CPU 601 of the controller 600 looks up the lookup table from the RAM 604 or the like, and distributes the printing data to the nozzle arrays so as to perform printing by the nozzles in a predetermined order.

In this driving method, for example, dot printing is performed by the two nozzle arrays in parallel, so the printing speed can be increased by increasing the scanning velocity of the printhead 1902H.

After that, in D14 of FIG. 7, printing data is read out while looking up the above-mentioned block driving table. In D15, signals (see FIG. 4) for driving the printhead 1902H are generated based on the readout printing data. In D16, the generated signals are transferred to the printhead 1902H so as to be assigned to the two nozzle arrays Nzl-A and Nzl-B.

3. Example of Nozzle Array Tilt Measuring Method

When the printhead 1902H is not appropriately mounted or the nozzle substrate including the plurality of nozzles is not appropriately installed in the printhead 1902H, the nozzle array arrangement direction has a tile with respect to the sub scanning direction. If the nozzle array arrangement direction has a tilt with respect to the sub scanning direction, the tilt is premeasured in order to correct dot printing positions.

Figure 9:
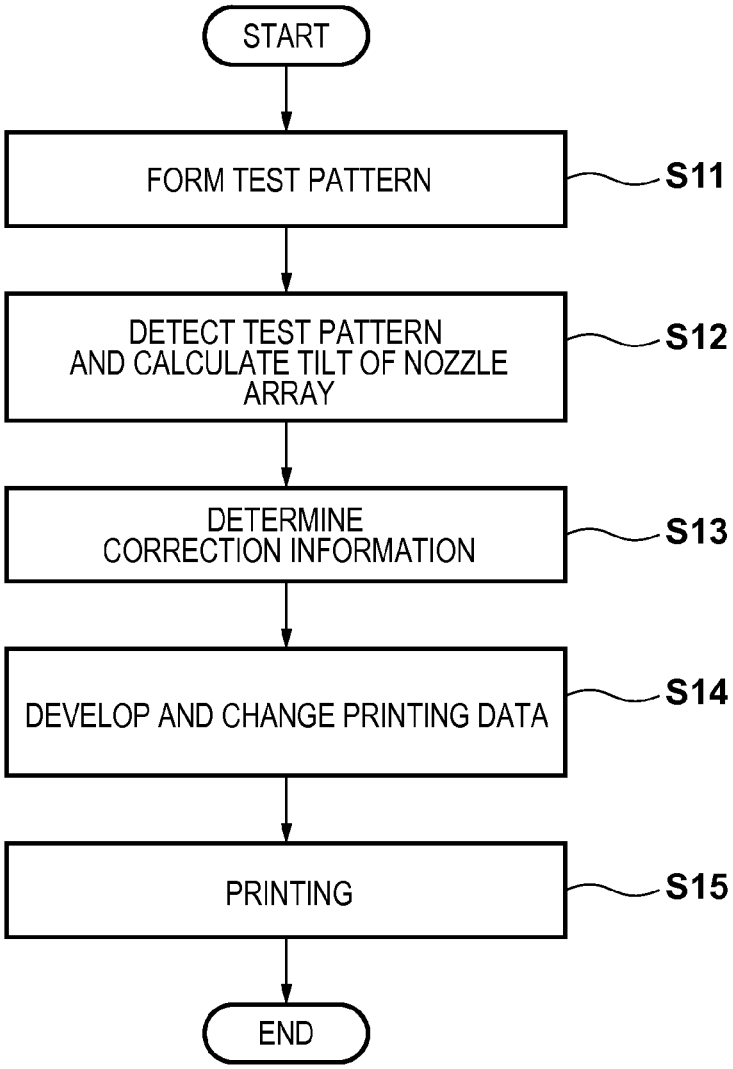
FIG. 9 is a view for explaining an example of a flowchart of a printing operation including printing position correction.

In this embodiment, an example of the nozzle array tilt measuring method will be explained with reference to FIGS. 9 to 13. FIG. 9 exemplarily shows a flowchart of a dot printing position correction method based on the nozzle array tilt measurement result and a printing operation including the correction.

First, in step S11 of FIG. 9, a test pattern for measuring a nozzle array tilt of the printhead 1902H is formed on a printing medium by driving the printhead 1902H. A well-known pattern for measuring a nozzle array tilt can be used as the test pattern. For example, the test pattern can be formed by driving some printing elements at different timings, and discharging ink from nozzles corresponding to the printing elements at different timings, thereby printing dots on the printing medium.

In step S12, a measuring unit including an optical sensor or the like is used to detect the test pattern, analyze the optical characteristic of the test pattern, and calculate a nozzle array tilt. This calculation can be performed based on, for example, the intensity distribution of reflected light obtained when the test pattern is irradiated with light.

In step S13, information (correction information) for correcting printing positions is determined based on the calculated nozzle array tilt. This correction information determination can include, for example, specifying a portion of printing data which requires rearrangement or change of data, and determining a parameter for correcting the data by a predetermined method. The determined correction information can be held as setting information necessary to perform printing by, for example, storing the information in a memory unit or the like.

In step S14, the printing data is developed based on the correction information determined in step S13, and, for example, the printing data is rearranged and a read position is changed (details will be described later). Note that this change may be performed after the development of the printing data, and may also be performed together with (simultaneously with) the development. After that, in step S15, printing based on the printing data is performed following the above-described procedure (see D14 to D16 in FIG. 7).

Figure 10:
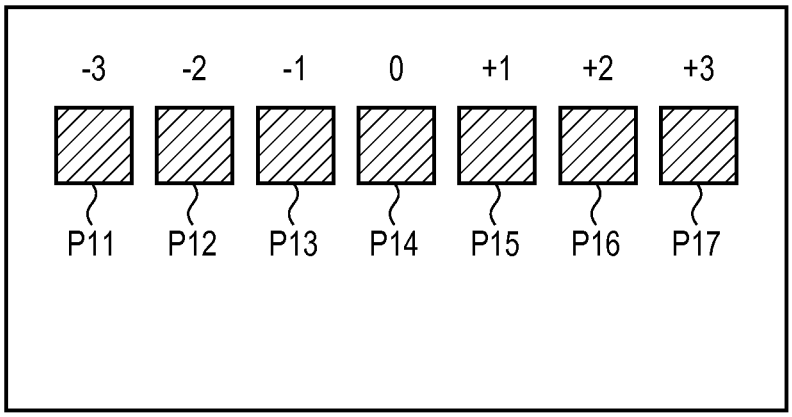
FIG. 10 is a view for explaining a test pattern example.

FIG. 10 is a schematic view for explaining an example of the test pattern for use in the above-mentioned nozzle array tilt measurement. This test pattern can include, for example, seven test patches P11 to P17 so formed that the ink discharge timings are different. In this example, the shift amounts of the different timings are indicated by "−3", "−2", "−1", "±0", "+1", "+2", and "+3".

Figure 11A:
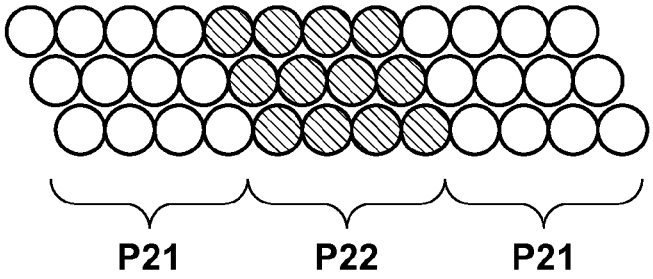
FIGS. 11A and 11B are views for explaining a test pattern example.
Figure 11B:
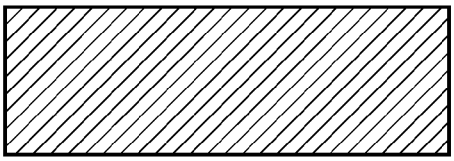

FIGS. 11A and 11B are schematic views for explaining an example of the test pattern, and shows a dot pattern to be formed by a test patch having a shift amount "±0" in an intended case (when there is no nozzle array tilt). As shown in FIG. 11A, this test patch includes two dot patterns P21 and one dot pattern P22. Each of the two dot patterns P21 is formed by printing four dots by each of three nozzles on the upstream side in the first scanning of the printhead 1902H. The dot pattern P22 is formed between the two dot patterns P21 by printing four dots by each of three nozzles on the downstream side in the second scanning of the printhead 1902H.

If the nozzle array has no tilt and the printing timings of the dot patterns P21 and P22 are appropriate, as shown in FIG. 11B, the dot patterns P21 and P22 match, and the uniform test patch P14 is formed. Note that the first scanning for printing the dot patterns P21 and the second scanning for printing the dot pattern P22 are preferably performed in the same scanning direction (for example, the +X direction).

On the other hand, the test patches P11, P12, and P13 are formed by making the printing timings of dots formed by the three nozzles on the downstream side earlier ("−3", "−2", and "−1") than that of the test patch P14 in the second scanning. Consequently, the dot pattern P22 to be printed by the three nozzles on the downstream side is formed as it is shifted by, for example, 3/2, 2/2, and 1/2 dots to the left from the region between the two dot patterns P21 formed by the first scanning. Note that these shift amounts can be considered as dot pitches in the X direction (main scanning direction), or a predetermined distance (for example, the size of one dot) can be considered as a unit, and the shift amount can be determined based on an arbitrary reference.

Similarly, the test patches P15, P16, and P17 are formed by making the printing timings of dots formed by the three nozzles on the downstream side later ("+1", "+2", and "+3") than that of the test patch P14 in the second scanning. Consequently, the dot pattern P22 to be printed by the three nozzles on the downstream side is formed as it is shifted by, for example, 1/2, 2/2, and 3/2 dots to the right from the region between the two dot patterns P21 formed by the first scanning.

Figure 12A:
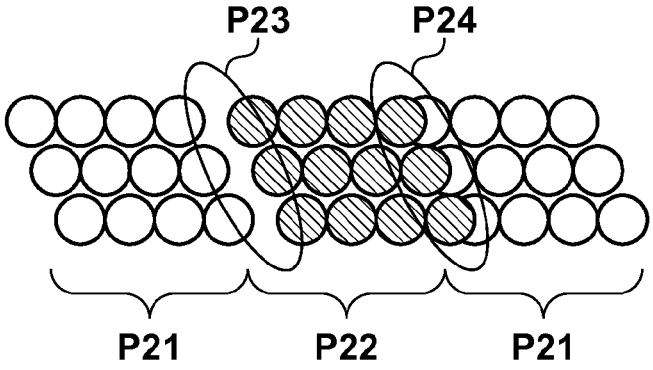
FIGS. 12A and 12B are views for explaining a test pattern example.
Figure 12B:
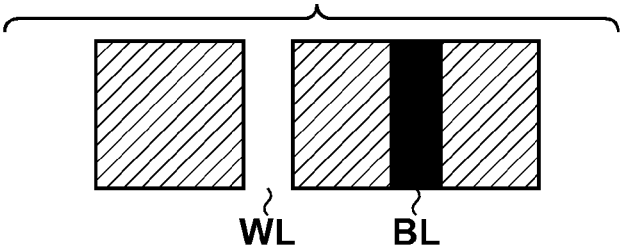

FIGS. 12A and 12B are schematic views for explaining another example of the test patch, and show a dot pattern to be formed by a test patch having a shift amount other than "±0" (for example, the test patch P15 having a shift amount "+1") in an intended case (when there is no nozzle array tilt). As shown in FIG. 12A, the dot pattern P22 is so printed as to overlap one (the right one) of the two dot patterns P21 and be spaced apart from the other one (the left one). Consequently, as shown in FIG. 12B, a test patch P15 including a black line BL and white line WL is formed. When the test pattern measurement described above (exemplified in steps S11 and S12 of FIG. 7) is performed, a nonuniform intensity distribution of reflected light is obtained by the lines BL and WL.

As described above, when the nozzle array of the printhead 1902H has no tilt with respect to the Y direction (sub scanning direction), as shown in FIGS. 11A and 11B, the dot patterns P21 and P22 match by the test patch P14 having a shift amount "±0".

On the other hand, if the nozzle array of the printhead 1902H has a tilt with respect to the Y direction, the dot patterns P21 and P22 do not match by the test patch P14 having a shift amount "±0", and match by a test patch having a shift amount other than "±0".

That is, a tilt of the nozzle array of the printhead 1902H with respect to the Y direction (sub scanning direction) can be measured in accordance with one of the test patches P11 to P16 by which the dot patterns P11 and P22 match. The correction information described above (exemplified in step S13 of FIG. 7) can be determined based on the measured tilt.

For example, when the dot patterns P21 and P22 match by the test patch P12 having a shift amount "−2", a correction value based on a shift amount "−2" is set. This correction value is equivalent to, for example, a parameter for specifying a portion to be rearranged (or changed) in the printing data.

FIG. 13 exemplarily shows a lookup table for specifying a group of correction values when the dot patterns P21 and P22 bmatch by the test patch P12 having a shift amount "−2". A correction value for each group $G_k$ is specified by this lookup table. For example, a group $G_2$ has a correction value "4", and a portion corresponding to the group $G_2$ in the printing data is changed based on a correction value "4".

In this embodiment, a mode in which the test pattern is detected by using an optical sensor is exemplified as an example of the method of measuring a tilt of the nozzle array of the printhead 1902H. However, the measuring method is not limited to this one. For example, it is also possible to allow the user to visually determine the test pattern, and measure a nozzle array tilt based on the determination result. The test pattern need only be formed by using a predetermined number of nozzles (for example, an amount sufficient to detect the test pattern), so the number is not limited to the exemplified number. Furthermore, a nozzle array tilt can also be measured by another measuring method. For example, a nozzle array tilt can also be measured by measuring two dot patterns (whether the dot patterns overlap each other or are spaced apart from each other, and the amount of overlap or space) formed by a predetermined number of nozzles in one end portion and the other end portion of the nozzle array.

4. Printing Position Shift Correction Method

Several examples of a printing position shift correction method when the nozzle array has a tilt will be described below with reference to the accompanying drawings.

4.1. Reference Example

A reference example of the printing position shift correction method when performing printing by the nozzle arrays Nzl-A and Nzl-B of the printhead 1902H by using the above-described lookup table (see, for example, FIGS. 5 and 8) will be described below.

Figure 14A:
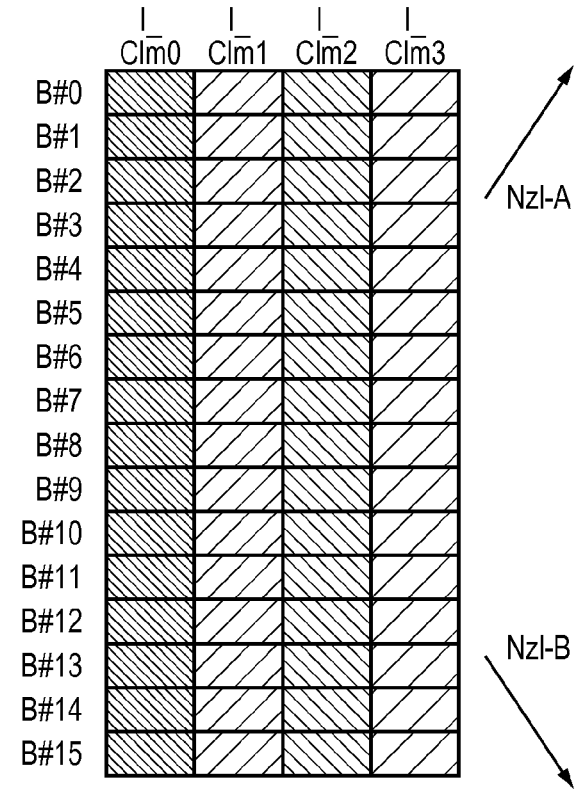
FIGS. 14A and 14B are views for explaining an example of a printing data processing method.
Figure 14B:
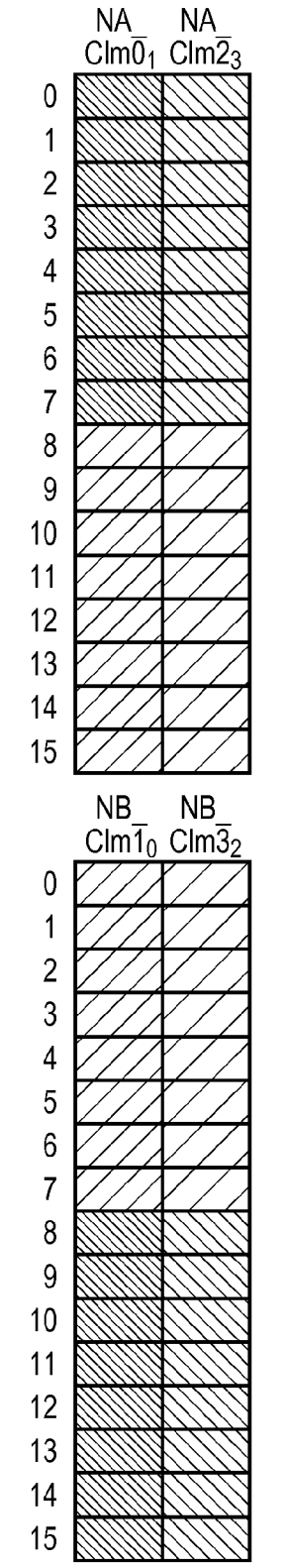

FIGS. 14A and 14B are views showing an example of a method of developing ODD data of printing data input to the printing apparatus PA, and an example of a method of distributing the developed printing data.

Note that in this specification, ODD of ODD and EVEN will be shown in other drawings (drawings for explaining data and drawings for explaining nozzles and dots) as well, in order to facilitate the explanation.

First, as shown in FIG. 14A, printing data is developed column by column in each group $G_k$ so as to correspond to each column on a printing medium. More specifically, the printing data is developed into ODD data I_Clm (for example, I_Clm0 to I_Clm3) corresponding to each column.

This developing process is performed on a memory such as a RAM. Each memory of the memory unit has a unique address. The addresses of memories correspond to positions where dots are to be printed in each column, and are associated with nozzles for printing the dots. For example, data I_Clm0 of the developed printing data is formed by 16-bit data indicating whether to print each of 16 dots in column 0. The addresses of memories for storing the 16-bit data forming data I_Clm0 are associated with 16 nozzles for printing the dots in column 0 based on data I_Clm0.

Note that data I_Clm and the like in FIG. 14A are given the block numbers (B#0 to B#15) of corresponding nozzles, instead of the memory addresses, in order to facilitate the explanation. This similarly applies to data I_Clm1 to I_Clm3. Note also that FIG. 14A shows data I_Clm0 to I_Clm3 in order to facilitate the explanation, but the same shall apply to data I_Clm4 and subsequent data.

As exemplarily shown in FIG. 14B, developed printing data I_Clm (ODD data I_Clm) is distributed to the ODD array of the nozzle array Nzl-A and the ODD array of the nozzle array Nzl-B. More specifically, developed printing data I_Clm is sequentially output to correspond to printing elements Seg#(32k+(2 m+1)) to be driven based on the control signal ODD of the nozzle array Nzl-A, and to printing elements Seg#(32k+(2 m+1)) to be driven based on the control signal ODD of the nozzle array Nzl-B. In this embodiment, of above-described developed printing data I_Clm, data to be distributed to the ODD array of the nozzle array Nzl-A is denoted by "NA_Clm (for example, $NA_Clm0_1$ to $NA_Clm2_3$)". Also, data to be distributed to the ODD array of the nozzle array Nzl-B is denoted by "NB_Clm (for example, $NB_Clm1_0$ to $NB_Clm3_2$)".

Note that the scanning velocity of the printhead 1902H can be almost doubled because nozzles of two nozzle arrays print data in parallel based on data distributed to the two nozzle arrays.

Figure 15:
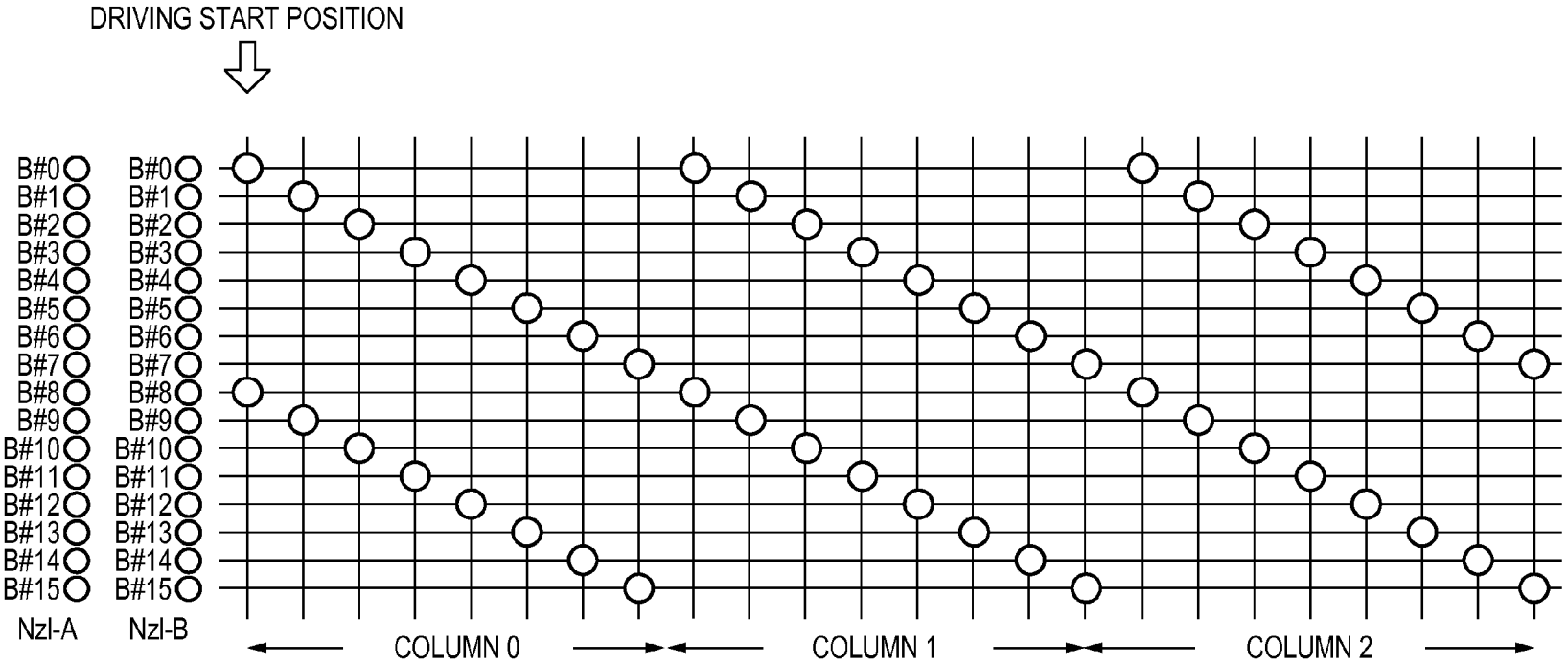
FIG. 15 is a view for explaining dots printed on a printing medium.

FIG. 15 is a schematic view for explaining dots to be printed on a printing medium by the nozzles of the ODD array of the nozzle array Nzl-A and the nozzles of the ODD array of the nozzle array Nzl-B. In column 0, dots are printed by eight nozzles on the downstream side (B#0 to B#7) of the ODD array of the nozzle array Nzl-A, and eight nozzles on the upstream side (B#8 to B#15) of the ODD array of the nozzle array Nzl-B. In next column 1, dots are printed by eight nozzles on the upstream side (B#8 to B#15) of the ODD array of the nozzle array Nzl-A, and eight nozzles on the downstream side (B#0 to B#7) of the ODD array of the nozzle array Nzl-B. Thus, the above-mentioned printing operation is repetitively performed from column 2 and subsequent columns. Note that in FIG. 15, each dot is given "A" or "B" so as to show a nozzle array to which the nozzle having printed the dot belongs.

Figure 16:
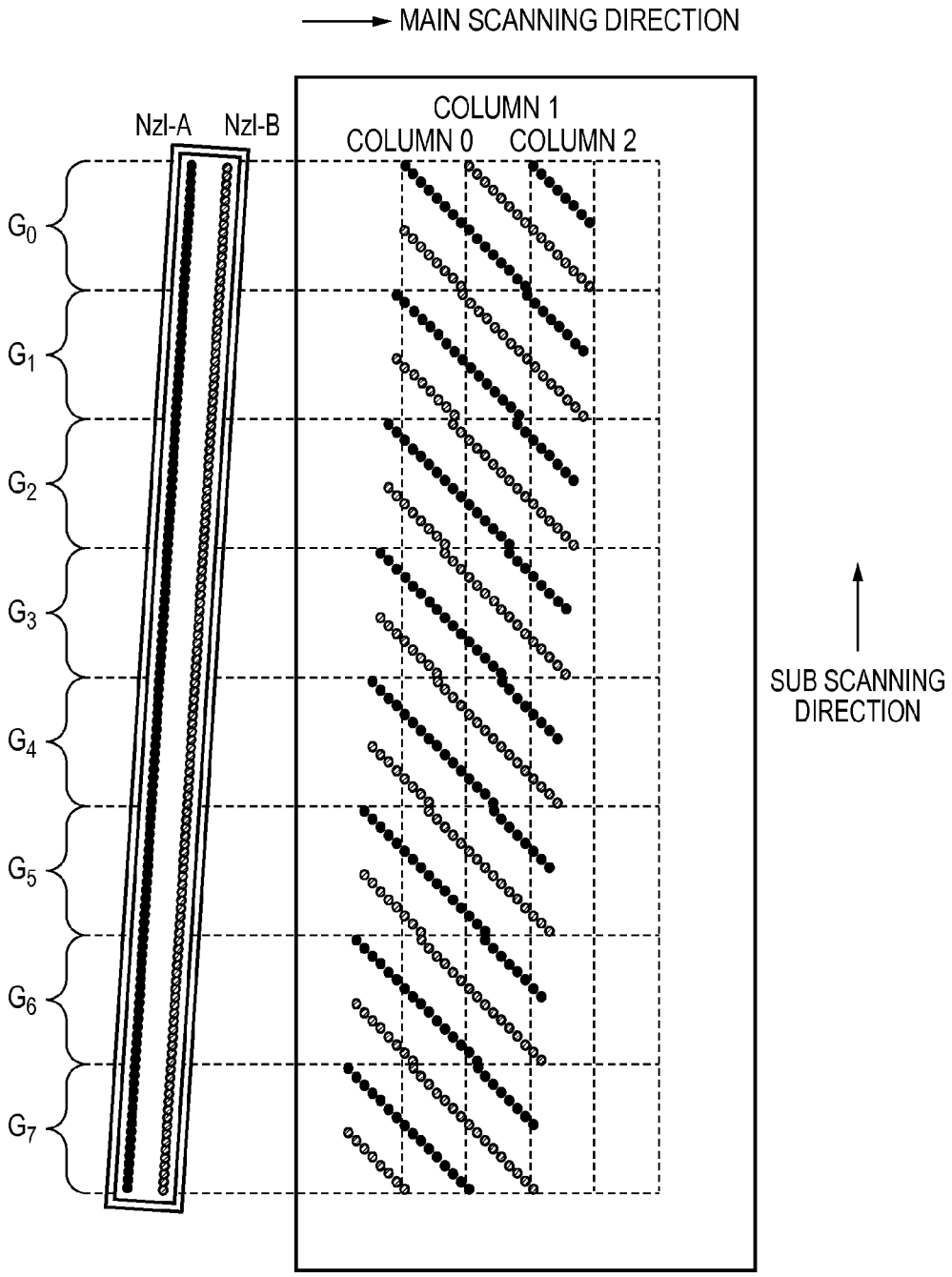
FIG. 16 is a view for explaining dots printed on a printing medium.

A case in which the arrangement direction of the nozzle arrays Nzl-A and Nzl-B has a tilt with respect to the Y direction (sub scanning direction) will be described below with reference to FIGS. 16 to 18. When dot printing position correction (for example, rearrangement of printing data) is not performed, as exemplarily shown in FIG. 16, dots corresponding to the tilt are printed on a printing medium, and as a consequence some dots are printed in positions deviated from corresponding columns (outside the corresponding columns). In group $G_2$, for example, two dots on the downstream side printed by the ODD nozzles in the nozzle array Nzl-A and two dots on the downstream side printed by the ODD nozzles in the nozzle array Nzl-B are positioned on the left sides of corresponding columns.

Figures 17A, 17B, 17C:
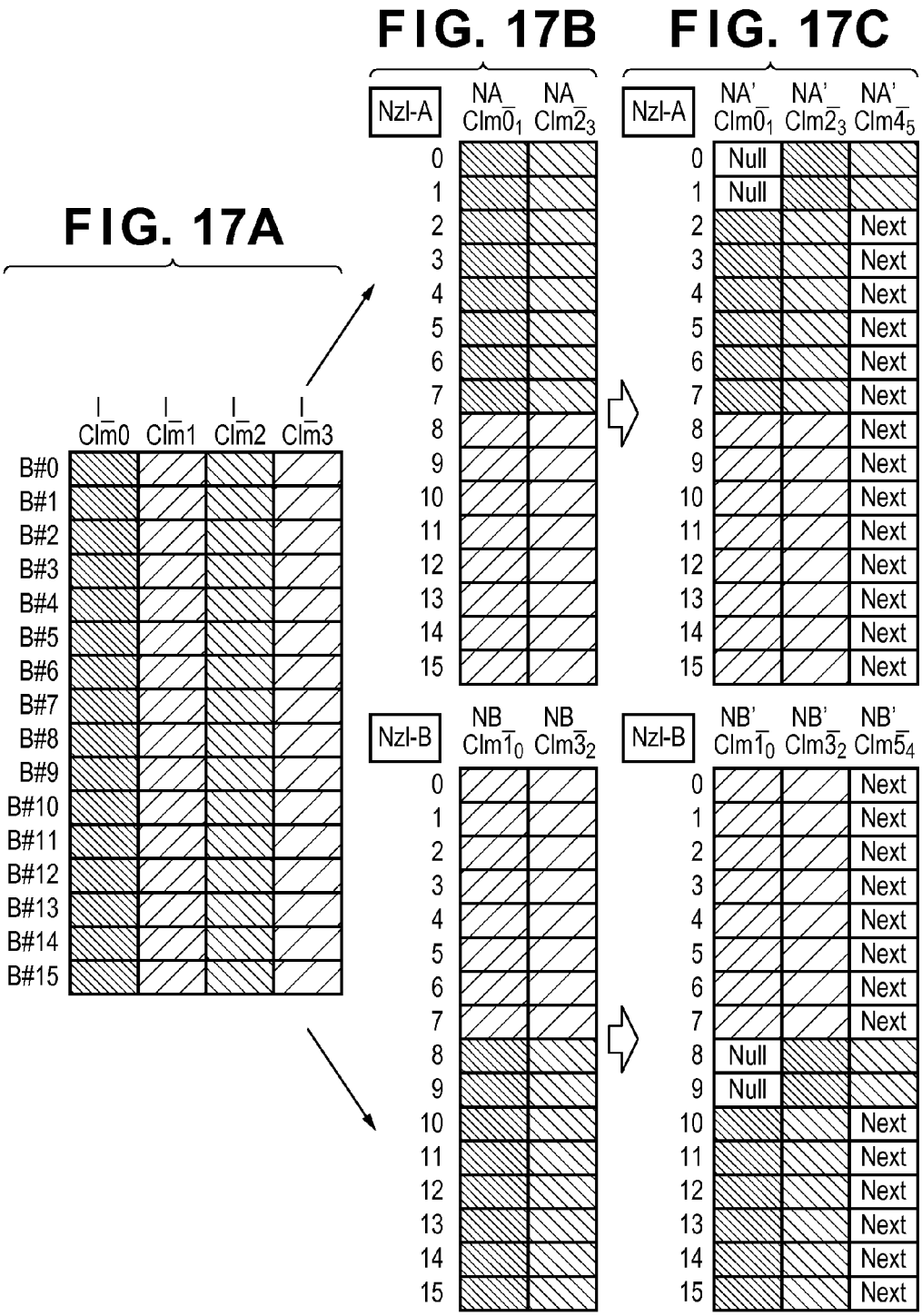
FIGS. 17A to 17C are views for explaining an example of the printing data processing method.
Figure 18:
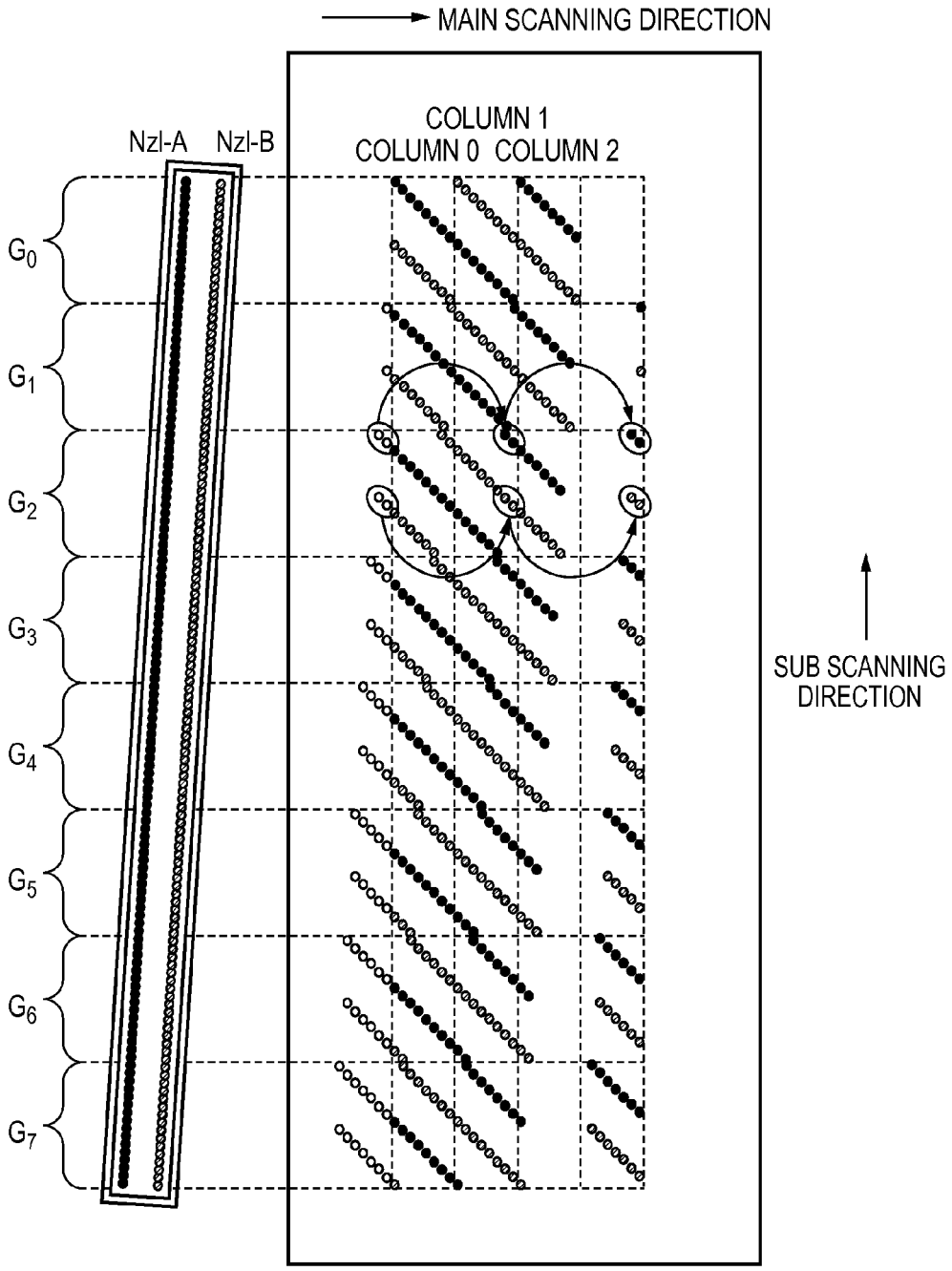
FIG. 18 is a view for explaining dots printed on a printing medium.

FIGS. 17A, 17B, and 17C respectively show an example of a printing data developing method, an example of a developed printing data distribution method, and an example of a printing position shift correction method according to this reference example. FIGS. 17A and 17B are similar to FIGS. 14A and 14B.

In this reference example as exemplarily shown in FIG. 17C, distributed printing data NA_Clm and NB_Clm are rearranged based on a tilt of the nozzle array Nzl-A and the like measured by the above-described measuring method (see, for example, FIG. 9). More specifically, based on a correction value specified by the tilt, a portion of the distributed printing data NA_Clm or the like is shifted by inserting, for example, null data (indicated by "Null" in FIG. 17C).

The rearrangement of the printing data described above is performed on a memory such as a RAM. Each memory of the memory unit has a unique address as described previously. The rearrangement of the printing data can be performed by, for example, moving data stored in a memory having an address corresponding to a nozzle for printing a dot as a correction target to a memory having another address. This makes it possible to change the read position of printing data, and change the read timing of the printing data (that is, the timing of printing by a nozzle corresponding to the dot as a correction target). FIG. 17C shows the printing data by "NA'_Clm (for example, NA'_Clm$0_1$ to NA'_Clm$4_5$)" and "NB'_Clm (for example, NB'_Clm$1_0$ to NB'_Clm$5_4$)". Note that "Next" in FIG. 17C indicates printing data from column 4.

After that, based on the rearranged printing data, printing is performed following the above-described procedure (see D14 to D16 in FIG. 7). Note that the explanation has been made by focusing on the ODD arrays of the nozzle arrays Nzl-A and Nzl-B in order to facilitate the explanation, but the same shall apply to the EVEN arrays.

In the correction method of this reference example, the read position of a shifted portion of distributed printing data NA_Clm or the like is changed, and the printing timing of each dot corresponding to the shifted portion is delayed by two columns. Consequently, as shown in FIG. 18, the printing positions of dots to be corrected are shifted by a distance equivalent to the two columns. Referring to FIG. 18, hollow dots ("○" in FIG. 18) indicate dots printed when the dot printing positions are not corrected. For example, in the correction method of this reference example, a total of four dots to be printed in column 0 are printed in column 1.

4.2. First Embodiment

The first embodiment of the printing position shift correction method when the arrangement direction of the nozzle arrays Nzl-A and Nzl-B has a tilt with respect to the Y direction (sub scanning direction) as in the above-described reference example will be described below with reference to, for example, FIGS. 19A to 20. Note that a case in which printing is performed by the nozzle arrays Nzl-A and Nzl-B by using the lookup table exemplarily shown in FIG. 8 will be explained as in the reference example.

Figures 19A, 19B, 19C:
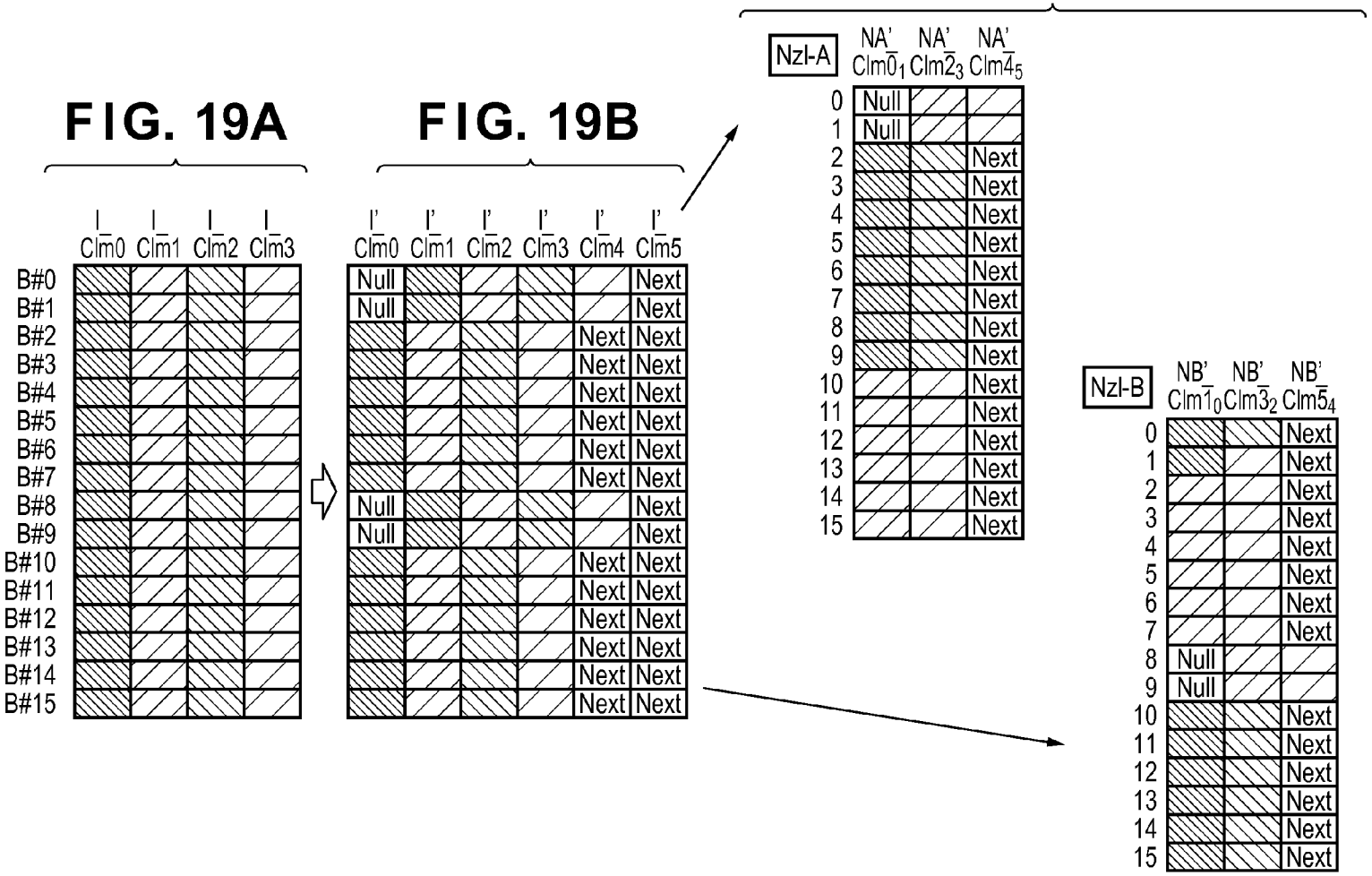
FIGS. 19A to 19C are views for explaining an example of the printing data processing method.

FIGS. 19A, 19B, and 19C respectively show an example of a method of developing ODD data of printing data, an example of a printing position shift correction method, and an example of a developed printing data distribution method, according to this embodiment. FIG. 19A is similar to FIGS. 14A and 17A. That is, printing data is developed in each group $G_k$ so as to correspond to each column on a printing medium. This developing process is performed on a memory such as a RAM. More specifically, the printing data is developed into data I_Clm (for example, I_Clm0 to I_Clm3) per unit column.

Developed printing data I_Clm (ODD data I_Clm) is rearranged based on a tilt of the nozzle array Nzl-A and the like measured by the above-described measuring method (see, for example, FIG. 9). As shown in, for example, FIG. 19B, this rearranging process is performed, based on the tilt, by shifting a portion of printing data I_Clm by inserting null data (indicated by "Null" in FIG. 19B). FIG. 19B shows the printing data by "I'_Clm (for example, I'_Clm0 to I'_Clm5)". Note that "Next" in FIG. 19B is printing data from column 4.

Note that the developing process and rearranging process of the printing data are separately performed, but they may also be performed at the same time. That is, the printing data may also be developed so as to obtain the state or arrangement after the above-mentioned portion is shifted. From another viewpoint, undeveloped or developed printing data is rearranged based on a tilt of the nozzle array Nzl-A and the like.

As shown in FIG. 19C, the printing data having undergone the developing process and rearranging process is distributed to the ODD arrays of the nozzle arrays Nzl-A and Nzl-B. More specifically, the printing data is distributed to the ODD arrays of the nozzle arrays Nzl-A and Nzl-B so that printing is performed by nozzles in the order of the lookup table exemplarily shown in FIG. 8. FIG. 19C shows the rearranged printing data by "NA'_Clm (for example, NA'_Clm$0_1$ to NA'_Clm$4_5$)" and "NB'_Clm (for example, NB'_Clm$1_0$ to NB'_Clm$5_4$)". Note that the rearranging process and distributing process of the printing data may also be performed at the same time as in the above-described mode in which the developing process and rearranging process of the printing data are performed at the same time.

After that, based on the printing data, printing is performed following the above-described procedure (see D14 to D16 in FIG. 7). As a consequence, dots whose printing positions are deviated from corresponding columns when no correction is performed because the nozzle array Nzl-A and the like have a tilt are printed in the corresponding columns as shown in FIG. 20. Note that the explanation has been made by focusing on the ODD arrays of the nozzle arrays Nzl-A and Nzl-B in order to facilitate the explanation, but the same shall apply to the EVEN arrays. Note also that in FIG. 20, hollow dots ("○" in FIG. 20) indicate dots printed when the dot printing positions are not corrected.

Referring to FIG. 16 again, two dots (a total of four dots) on the downstream side among dots printed by nozzles of group $G_2$ in each of the ODD arrays of the nozzle arrays Nzl-A and Nzl-B are printed on the left side of a corresponding column. In the correction method of the above-described reference example, as shown in FIG. 18, dots as targets of printing position shift correction are printed on the right side of the corresponding column when they are shifted by the distance equivalent to two columns.

In this embodiment, printing data is rearranged based on a tilt of, for example, the nozzle array Nzl-A before being distributed to, for example, the nozzle array Nzl-A, and the read position of the rearranged portion of the printing data is changed. After that, the printing data is distributed to the nozzle array Nzl-A and the like. The above-mentioned two dots on the downstream side in group $G_2$ are appropriately printed in the corresponding column by delaying, by one column, the printing timings of dots corresponding to the rearranged portion. In the correction method of this embodiment, all dots are appropriately printed in corresponding columns even when the nozzle array Nzl-A and the like have a tilt. As described above, this embodiment is advantageous in correcting a printing position shift when the arrangement direction of two or more nozzle arrays has a tilt with respect to the sub scanning direction.

4.3. Second Embodiment

The second embodiment will be explained with reference to, for example, FIGS. 21 to 23. In the above-described first embodiment, the case in which printing is performed in the block number order (see FIG. 8) has been explained in order to facilitate the explanation. However, when performing the above-described printing position shift correction, the nozzle use order need only be predetermined and is not limited to the above-mentioned mode. For example, printing may also be performed by the nozzle arrays Nzl-A and Nzl-B in an order exemplarily shown in FIG. 21. The nozzles of the nozzle arrays Nzl-A and Nzl-B are used such that the half (eight nozzles) on the downstream side and the half (eight nozzles) on the upstream side are alternately used in this case as well.

Figures 22A, 22B, 22C:
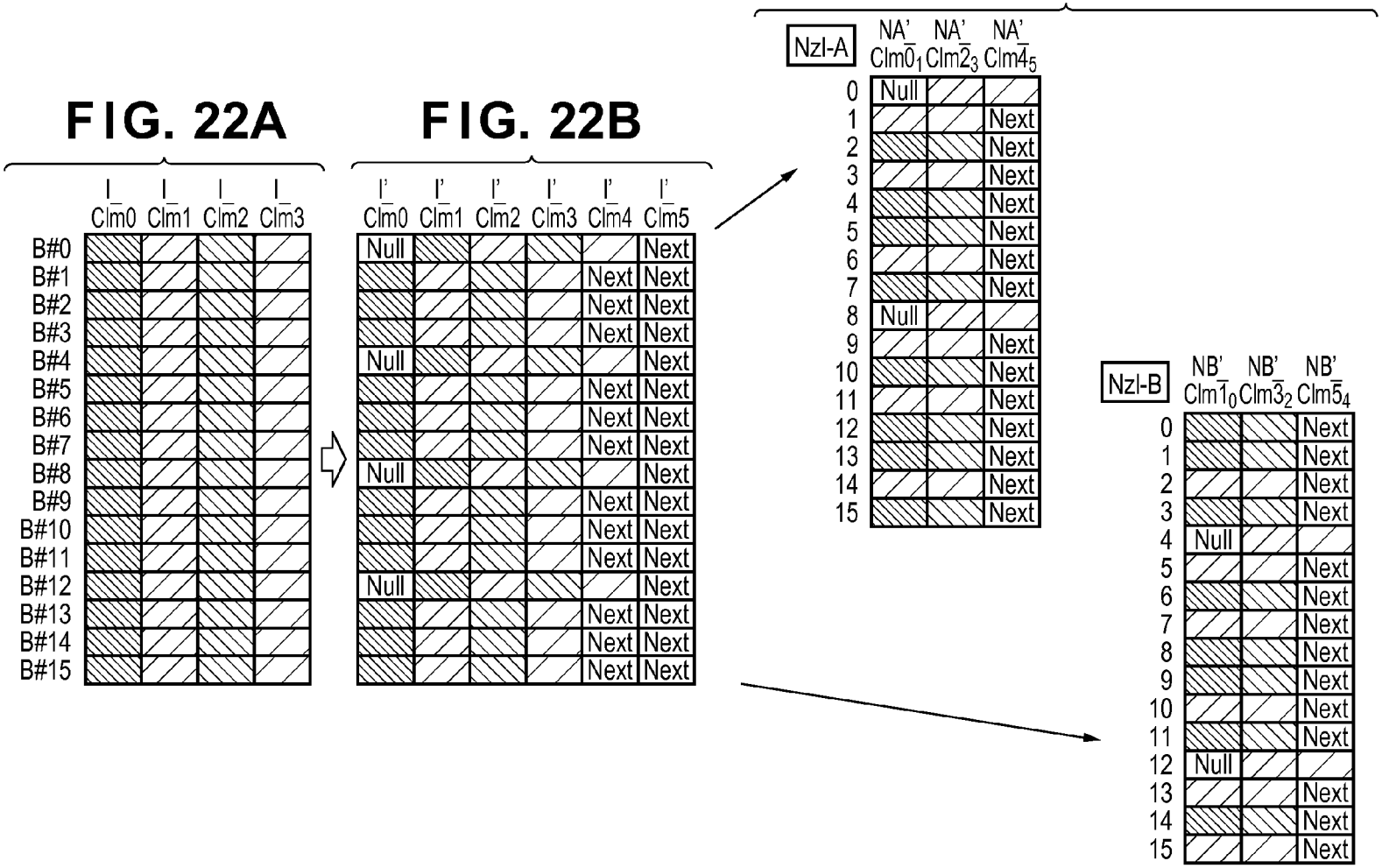
FIGS. 22A to 22C are views for explaining an example of the printing data processing method.

FIGS. 22A, 22B, and 22C respectively show an example of a method of developing ODD data of printing data, an example of a printing position shift correction method, and an example of a developed printing data distribution method according to this embodiment. FIG. 22A is a schematic view showing the developed printing data as in the first embodiment (FIG. 19A) and the like.

Developed printing data I_Clm (ODD data I_Clm) is rearranged based on a tilt of the nozzle array Nzl-A and the like. As shown in, for example, FIG. 22B, this rearranging process is performed, based on the tilt, by shifting a portion of printing data I_Clm by inserting null data (indicated by "Null" in FIG. 22B).

In this embodiment as exemplarily shown in FIG. 21, the block numbers of nozzles for printing the first two dots in the nozzle array Nzl-A are "B#0" and "B#8". Also, the block numbers of nozzles for printing the first two dots in the nozzle array Nzl-B are "B#4" and "B#12". In the example shown in FIG. 22B, therefore, null data (indicated by "Null" in FIG. 22B) is inserted into four portions "B#0", "B#4", "B#8", and "B#12", and the printing data is thus rearranged.

As shown in FIG. 22C, printing data I'_Clm (for example, I'_Clm0 to I'_Clm5) having undergone the developing process and rearranging process is distributed to the ODD arrays of the nozzle arrays Nzl-A and Nzl-B. This distribution process is performed based on the printing order of the nozzles.

Referring to FIG. 21, in the nozzle array Nzl-A, nozzles having block numbers "B#0, B#8, B#5, B#13, B#2, B#10, B#7, and B#15" sequentially print the first eight dots. Then, nozzles having block numbers "B#4, B#12, B#1, B#9, B#6, B#14, B#3, and B#11" sequentially print the next eight dots. On the other hand, in the nozzle array Nzl-B, nozzles having block numbers "B#4, B#12, B#1, B#9, B#6, B#14, B#3, and B#11" sequentially print the first eight dots. Then, nozzles having block numbers "B#0, B#8, B#5, B#13, B#2, B#10, B#7, and B#15" sequentially print the next eight dots.

Accordingly, for printing data NA'_Clm$0_1$, for example, those portions of I'_Clm0 which correspond to B#0, B#8, B#5, B#13, B#2, B#10, B#7, and B#15 and those portions of I'_Clm1 which correspond to B#4, B#12, B#1, B#9, B#6, B#14, B#3, and B#11 are assigned. For printing data NB'_Clm$3_2$, for example, those portions of I'_Clm3 which correspond to B#0, B#8, B#5, B#13, B#2, B#10, B#7, and B#15 and those portions of I'_Clm2 which correspond to B#4, B#12, B#1, B#9, B#6, B#14, B#3, and B#11 are assigned.

After that, based on the printing data, printing is performed following the above-described procedure (see D14 to D16 in FIG. 7). Note that the explanation has been made by focusing on the ODD arrays of the nozzle arrays Nzl-A and Nzl-B in order to facilitate the explanation, but the same shall apply to the EVEN arrays.

Figure 20:
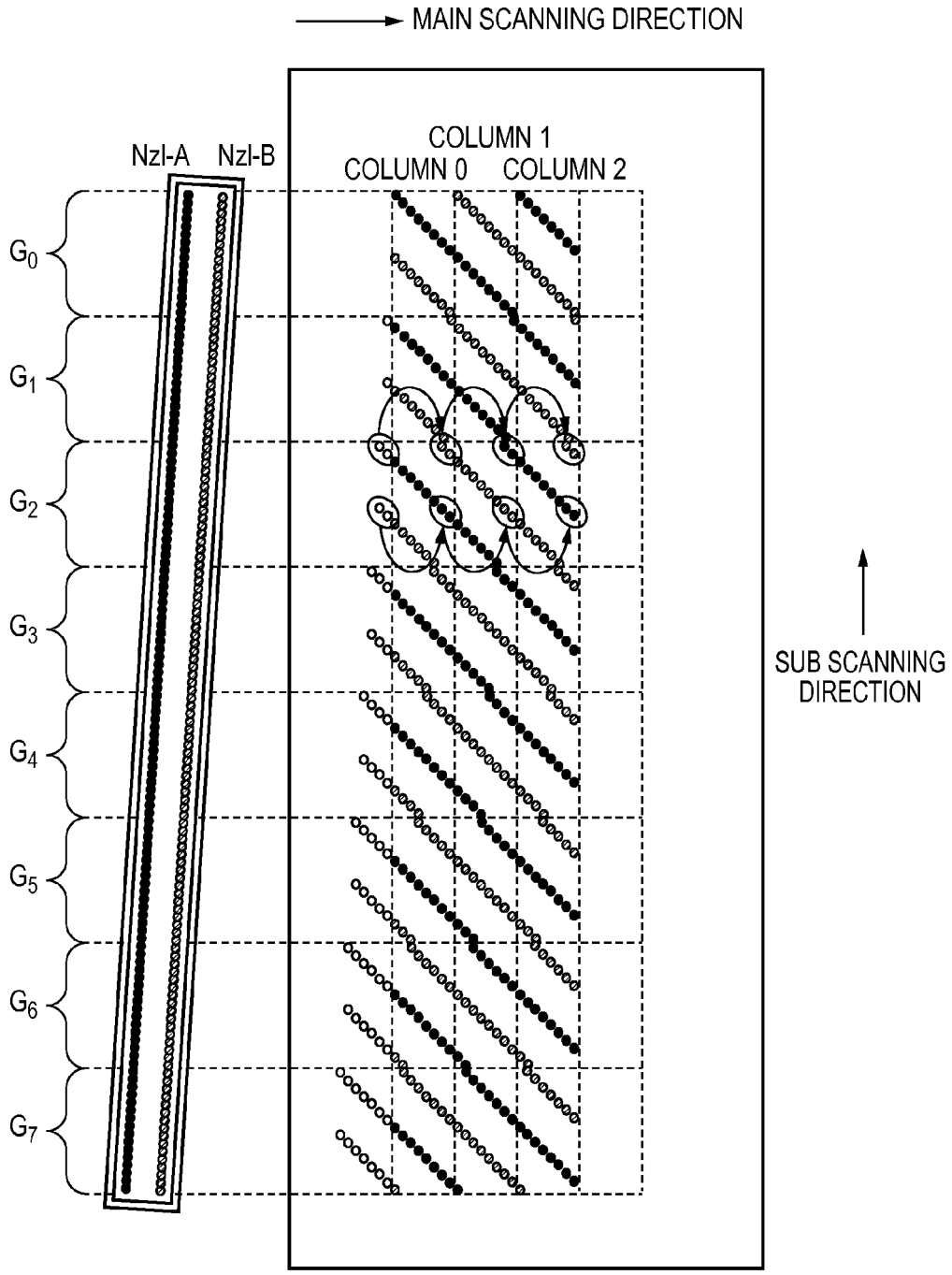
FIG. 20 is a view for explaining dots printed on a printing medium.
Figure 23:
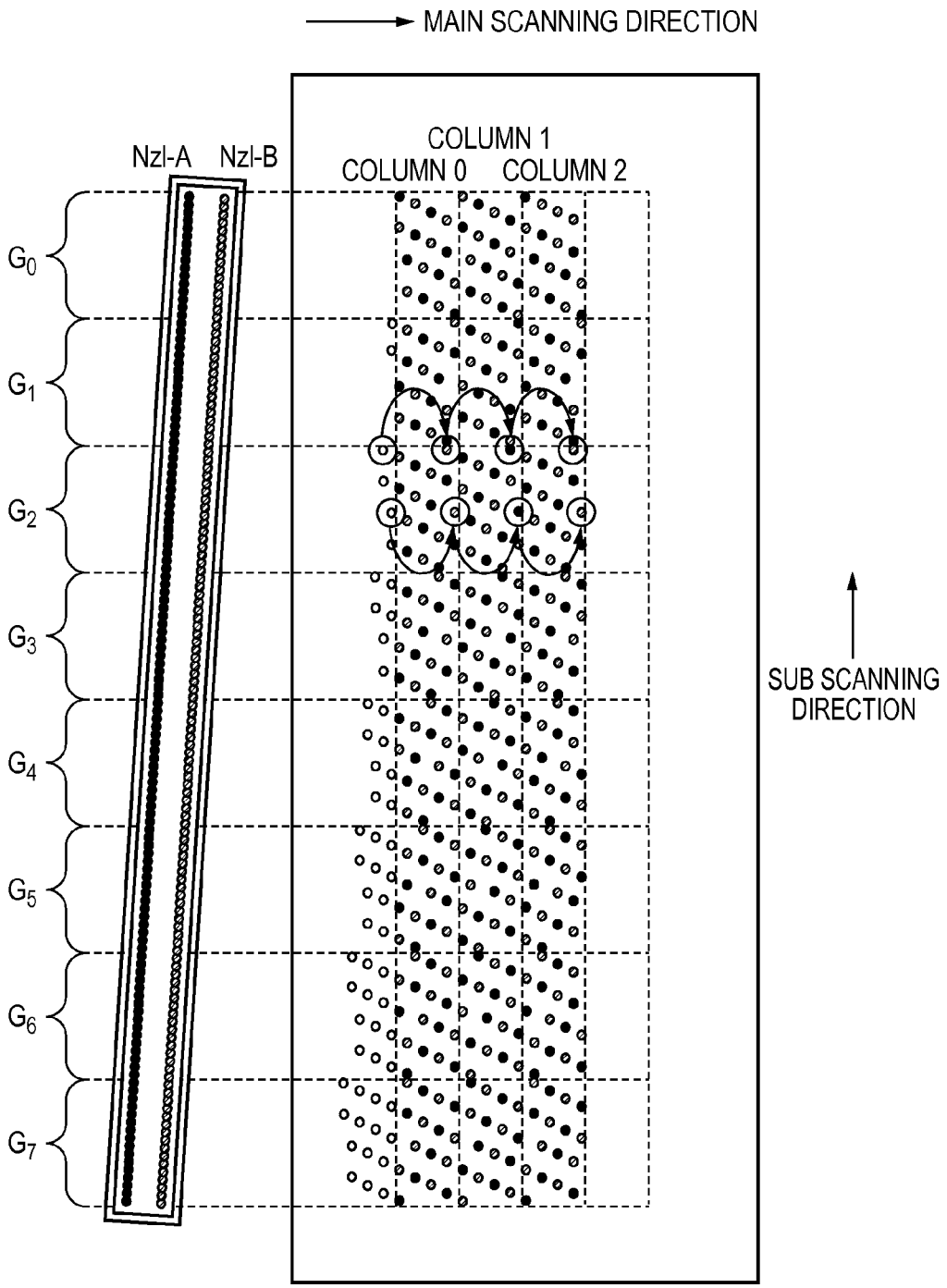
FIG. 23 is a view for explaining dots printed on a printing medium.

FIG. 23 is a schematic view for explaining dots to be printed in each column on a printing medium, in the same manner as in the first embodiment (FIG. 20). Referring to FIG. 23, hollow dots ("○" in FIG. 23) indicate dots printed when the dot printing positions are not corrected. Dots whose printing positions are deviated from corresponding columns when no correction is performed because the nozzle array Nzl-A and the like have a tilt are printed in the corresponding columns in this embodiment as well.

4.4. Third Embodiment

The third embodiment will be explained with reference to, for example, FIGS. 24A1 to 25C. In the first and second embodiments described above, the modes in which printing data is rearranged have been exemplified. However, the correction of a printing position shift is not limited to these modes. For example, printing data may also be changed by predetermined data processing which is determined by a tilt of the nozzle array Nzl-A and the like.

In this embodiment, a mask pattern corresponding to a correction value (see FIG. 13) specified by a tilt of the nozzle array Nzl-A and the like is selected based on the correction value, and developed printing data I_Clm is changed by using the selected mask pattern.

Note that in this embodiment, only ODD arrays are shown and a case in which printing is performed in the block number order (see FIG. 8) will be explained as in the first embodiment, in order to facilitate the explanation.

FIGS. 24A1 to 24B5 exemplarily show several mask patterns determined by correction values specified by a tilt of the nozzle array Nzl-A and the like. That is, FIGS. 24A1 to 24A5 respectively show mask patterns for the ODD array of the nozzle array Nzl-A when the correction values are "0", "2", "4", "6", and "8". Likewise, FIGS. 24B1 to 24B5 respectively show mask patterns for the ODD array of the nozzle array Nzl-B when the correction values are "0", "2", "4", "6", and "8". For example, when the correction value is "2" as a result of the above-described measurement (see, for example, FIG.

Figures 1, 24A:
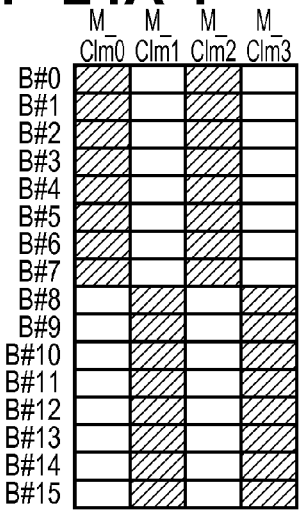
Figures 2, 24A:
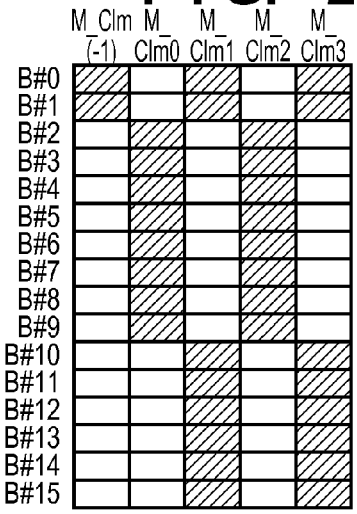
Figures 3, 24A:
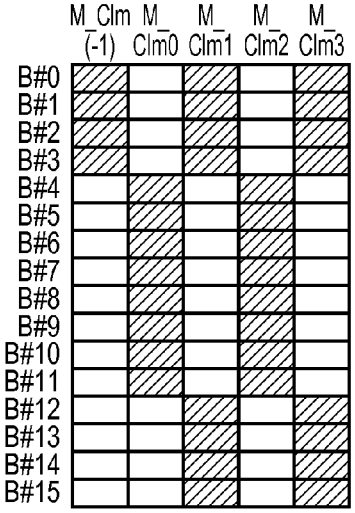
Figures 4, 24A:
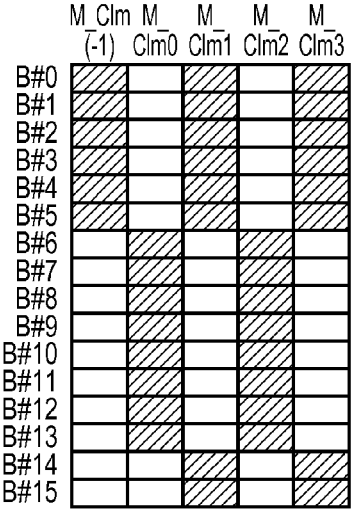
Figures 5, 24A:
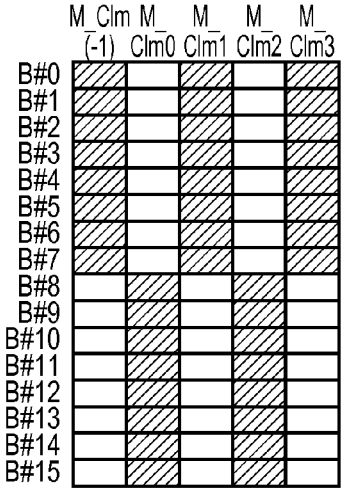
Figures 1, 24B:
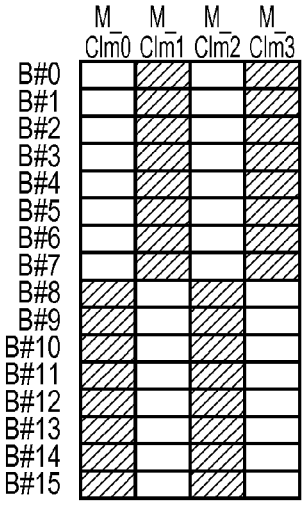
Figures 2, 24B:
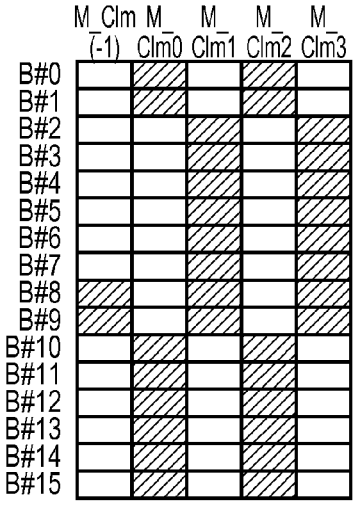
Figures 3, 24B:
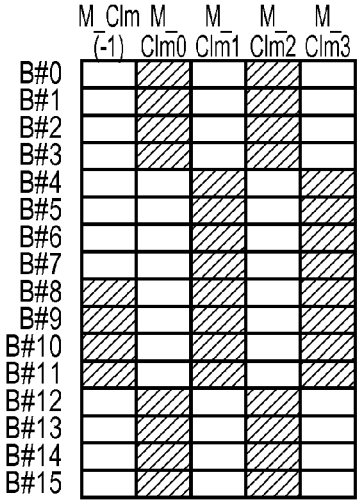
Figures 4, 24B:
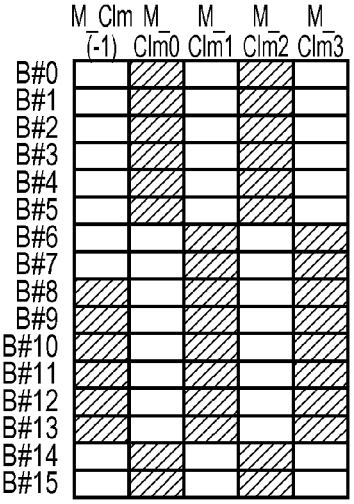
Figures 5, 24B:
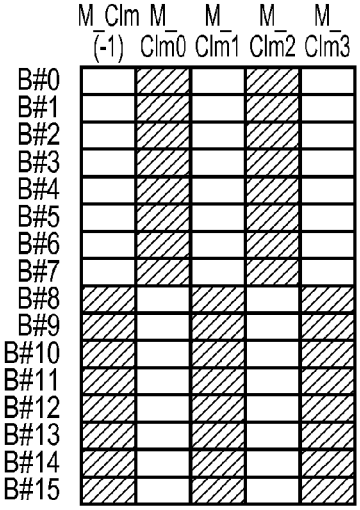

9) of a tilt of the nozzle array Nzl-A and the like, the two mask patterns shown in Figs. 24A2 and 24B2 are selected.

The mask pattern for the ODD array of the nozzle array Nzl-A and the mask pattern for the ODD array of the nozzle array Nzl-B are so formed as to complementarily select (or extract) data with respect to printing data (I_Clm0, I_Clm1, I_Clm2, . . . ) from column 0. In FIGS. 24A1 to 24B5, a hatched rectangle indicates the selection of 1-bit data forming the printing data, and a hollow rectangle indicates no selection. From another viewpoint, these mask patterns are mask data for ORing each bit data forming the printing data and "1" or "0". In FIGS. 24A1 to 24B5, these mask data are indicated by "M_Clm" in one-to-one correspondence with the columns of the printing data.

Also, when the correction value is larger than "0", each mask pattern can form some null data for a column (to be referred to as column (−1) hereinafter) before column 0 as indicated by "M_Clm(−1)" in FIGS. 24A1 to 24B5. This makes it possible to delay the timings at which the nozzles of the nozzle arrays Nzl-A and Nzl-B form dots.

Figures 25A, 25B, 25C:
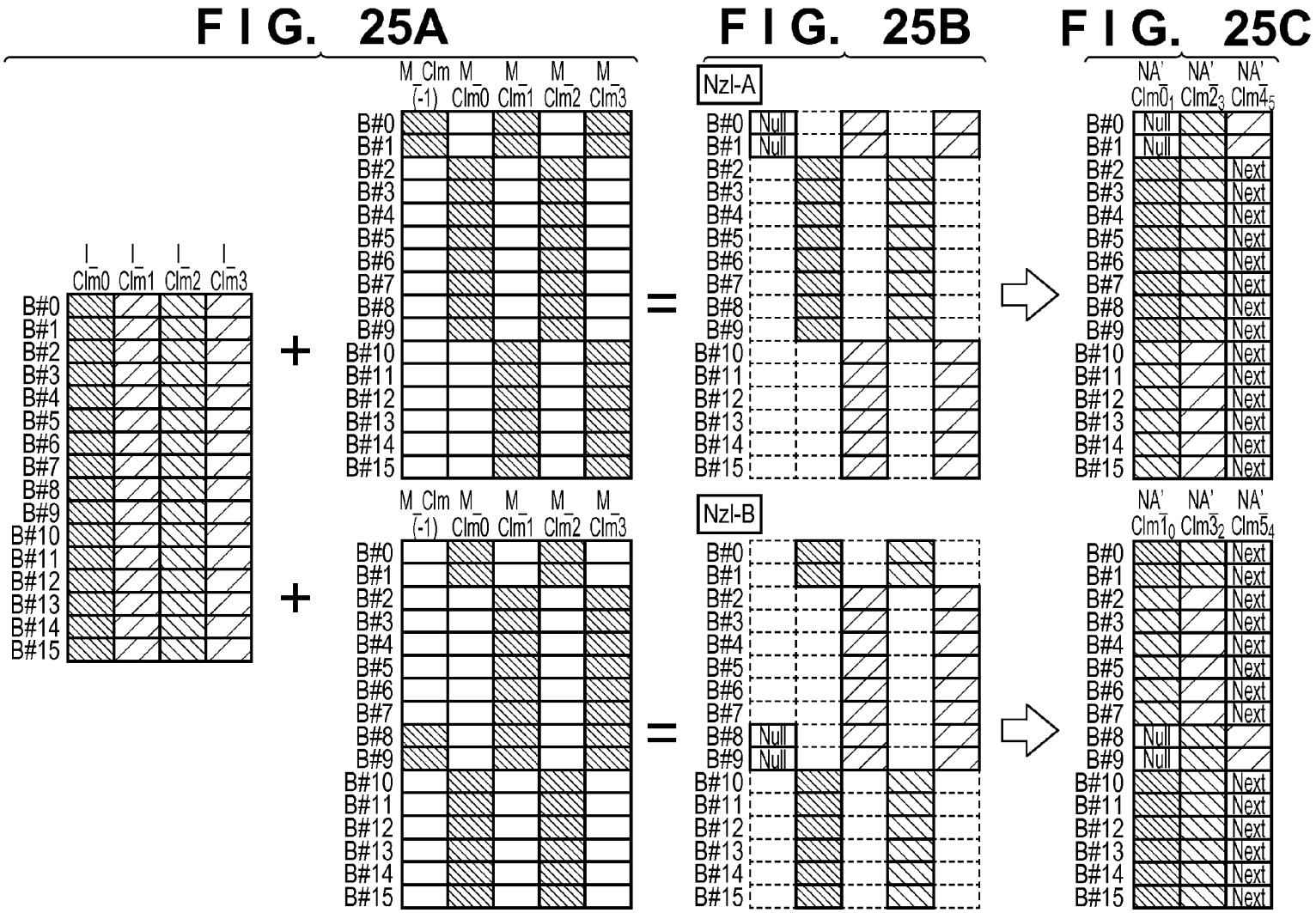
FIGS. 25A to 25C are views for explaining an example of the printing data processing method.

FIGS. 25A, 25B, and 25C respectively show examples of a printing data developing method and a mask pattern (or mask data) corresponding to a correction value "2", an example of a printing position shift correction method, and an example of a developed printing data distribution method.

As shown in FIG. 25A, for printing data to be distributed to the ODD array of the nozzle array Nzl-A, data processing using the mask pattern shown in FIG. 24A2 is performed on printing data I_Clm. Consequently, as shown in FIG. 25B, intermediate data for the ODD array of the nozzle array Nzl-A is generated. Analogously, for printing data to be distributed to the ODD array of the nozzle array Nzl-B, data processing using the mask pattern shown in FIG. 24B2 is performed on printing data I_Clm, and intermediate data for the ODD array of the nozzle array Nzl-B is generated.

After that, as shown in FIG. 25C, printing data NA'_Clm for the ODD array of the nozzle array Nzl-A and printing data NB'_Clm for the ODD array of the nozzle array Nzl-B are individually generated. Note that the explanation has been made by focusing on the ODD arrays in order to facilitate the explanation, but the same shall apply to the EVEN arrays.

In this embodiment as described above, mask patterns each corresponding to a tilt of the nozzle array Nzl-A and the like are prepared, and data processing is performed on printing data by using a mask pattern selected based on the measurement result of the tilt. The same effects as those of the first and second embodiments can be obtained by this embodiment as well.

4.5. Fourth Embodiment

The fourth embodiment will be explained with reference to, for example, FIGS. 26 to 30. In the above-described first to third embodiments, the arrangements in which a plurality of nozzles which discharge ink of the same color form two nozzle arrays in the printhead 1902H have been explained. However, the number of nozzle arrays may also be larger than two. For example, the printhead 1902H may include two or more nozzle substrates each having two or more nozzle arrays. In this embodiment, an arrangement in which the printhead 1902H includes two nozzle substrates NzS1 and NzS2 will be explained.

Figure 26:
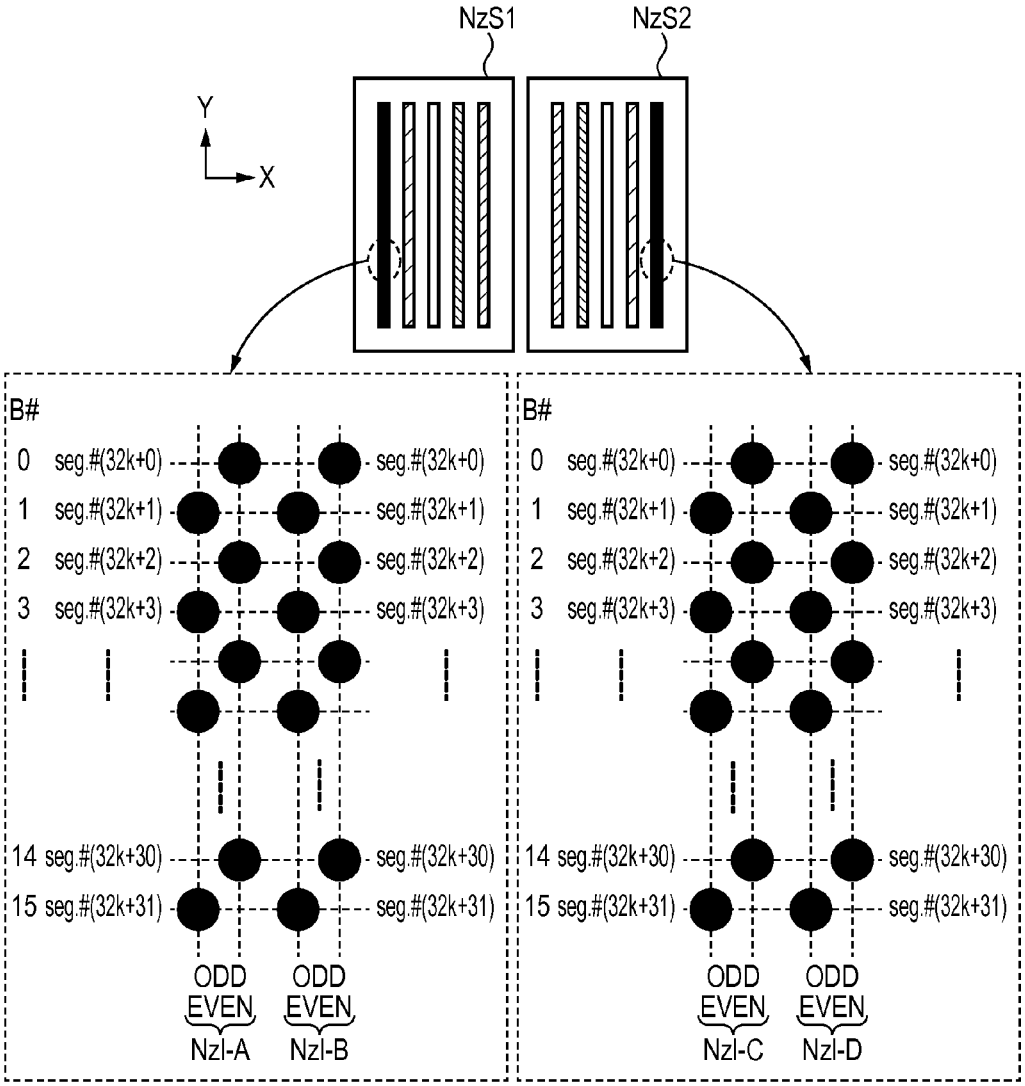
FIG. 26 is a view for explaining examples of nozzle arrays in which nozzles are arranged.

FIG. 26 is a schematic view for explaining the arrangement of the nozzle substrates NzS1 and NzS2. Each of the nozzle substrates NzS1 and NzS2 has the same arrangement as that shown in FIG. 5. The nozzle substrates NzS1 and NzS2 are so arranged as to be adjacent to each other in the X direction (main scanning direction). Also, the nozzle substrates NzS1 and NzS2 are so arranged as to be bilaterally symmetrical as shown in FIG. 26.

To facilitate the explanation, this embodiment will be described by focusing on the ODD arrays of two nozzle arrays Nzl-A and Nzl-B in the printhead substrate NzS1, and the ODD arrays of two nozzle arrays Nzl-C and Nzl-D in the printhead substrate NzS2. In each of the four nozzle arrays Nzl-A to Nzl-D, nozzles for discharging ink of the same color are arranged.

FIG. 27 shows an example of a lookup table defining the nozzle use order of each of the four nozzle arrays Nzl-A to Nzl-D.

According to this table, dots are initially printed by eight nozzles on the downstream side of the nozzle array Nzl-A, and eight nozzles on the upstream side of the nozzle array Nzl-B. Also, during this printing, dots are printed by four nozzles on the downstream side and four nozzles on the upstream side, that is, a total of eight nozzles of the nozzle array Nzl-C, and eight nozzles in the midstream of the nozzle array Nzl-D. Then, dots are printed by eight nozzles on the upstream side of the nozzle array Nzl-A, and eight nozzles on the downstream side of the nozzle array Nzl-B. In addition, during this printing, dots are printed by eight nozzles in the midstream of the nozzle array Nzl-C, and four nozzles on the upstream side and four nozzles on the downstream side, that is, a total of eight nozzles of the nozzle array Nzl-D. That is, the nozzles for printing dots are shifted by a ¼ period in the nozzle arrays Nzl-A to Nzl-D.

When the nozzle substrates NzS1 and NzS2 have different tilts with respect to the Y direction (sub scanning direction), it is necessary to individually perform the above-described printing position shift correction.

Figure 28:
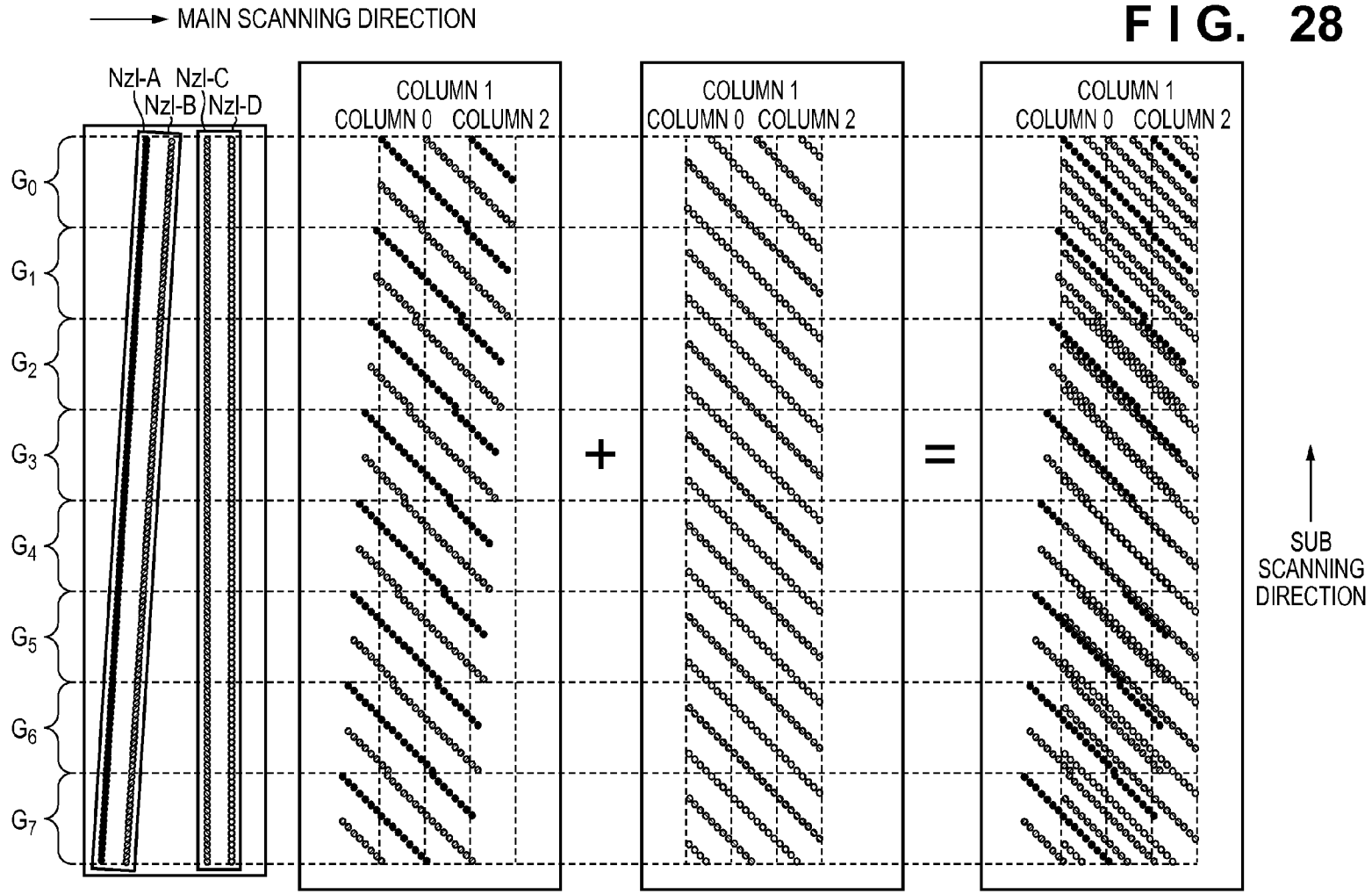
FIG. 28 is a view for explaining dots printed on a printing medium.

FIG. 28 is a schematic view for explaining dots printed in each column on a printing medium. In this embodiment, a case in which the nozzle substrate NzS1 (the nozzle arrays Nzl-A and Nzl-B) has a tilt and the nozzle substrate NzS2 (the nozzle arrays Nzl-C and Nzl-D) has no tilt will be explained. To make the drawing easy to understand, FIG. 28 individually shows ODD dots printed by the nozzle arrays Nzl-A and Nzl-B, and ODD dots printed by the nozzle arrays Nzl-C and Nzl-D.

When the above-described printing position shift correction is not performed, as shown in FIG. 28, dots corresponding to the tilt are printed on the printing medium, and as a consequence some dots are printed in positions deviated from corresponding columns. For example, in each of the nozzle arrays Nzl-A and Nzl-B, two dots (a total of four dots) on the downstream side of dots printed by the nozzles of the group $G_2$ are printed on the left side of the corresponding column.

FIGS. 29A1 to 29B2 show an example of a printing data developing method, an example of a printing position shift correction method, and an example of a developed printing data distribution method.

FIGS. 29A1, 29A2, and 29A3 respectively show an example of the printing data developing method, an example of the printing position shift correction method, and an example of the developed printing data distributing method for the nozzle substrate NzS1 (the ODD arrays of the nozzle arrays Nzl-A and Nzl-B). Printing data developed for the nozzle substrate NzS1 is indicated by "I1_Clm (for example, I1_Clm0)". Since the nozzle substrate NzS1 has a tilt, printing position shift correction based on the tilt is performed on developed printing data I1_Clm, thereby obtaining printing data I1'_Clm (for example, I1'_Clm0). Printing data I1'_Clm is distributed to the ODD arrays of the nozzle arrays Nzl-A and Nzl-B. The above data processing is the same as that shown in FIGS. 19A to 19C, so an explanation thereof will be omitted.

Figures 1, 2, 3, 29A:
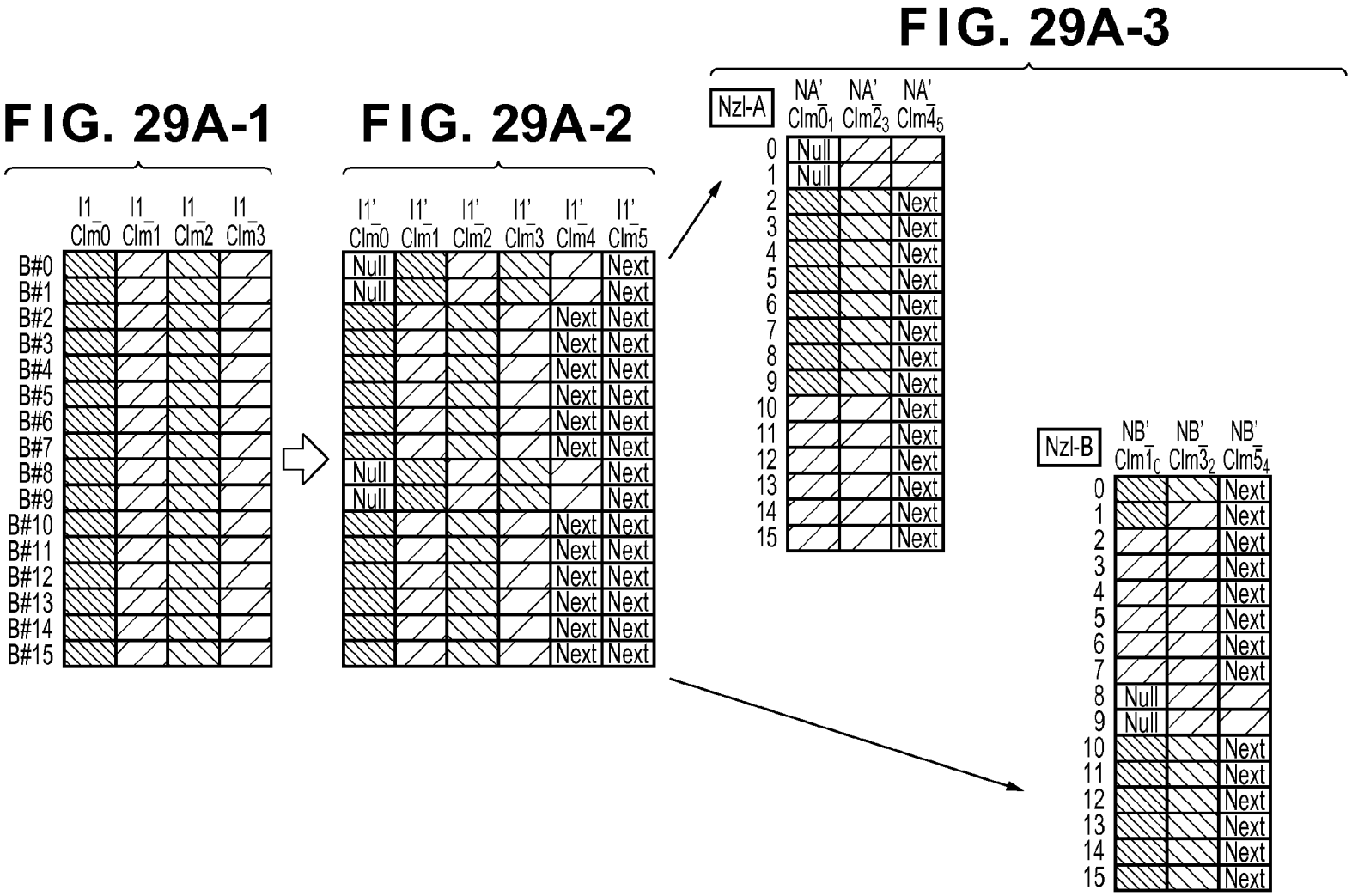
Figures 1, 29B:
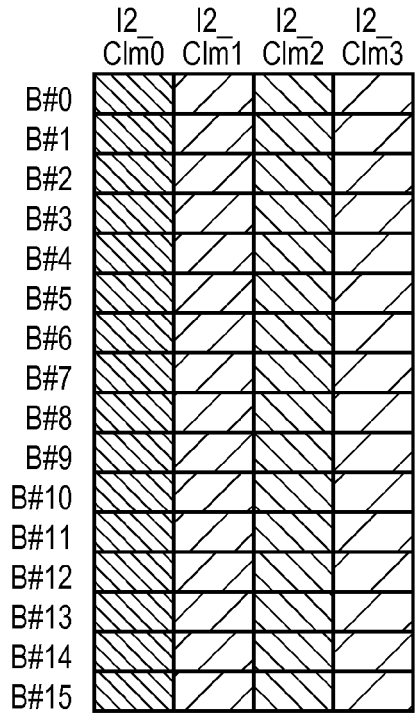
Figures 2, 29B:
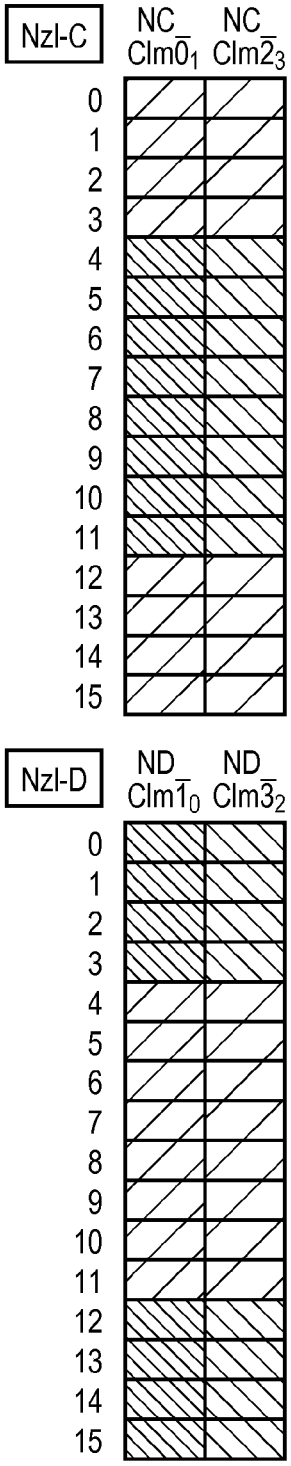

FIGS. 29B1 and 29B2 respectively show an example of the printing data developing method and an example of the developed printing data distributing method for the nozzle substrate NzS2 (the ODD arrays of the nozzle arrays Nzl-A and Nzl-B). Printing data developed for the nozzle substrate NzS2 is indicated by "I2_Clm (for example, I2_Clm0)". Since the nozzle substrate NzS2 has no tilt, no printing position shift correction needs to be performed. Printing data I2_Clm is distributed to the ODD arrays of the nozzle arrays Nzl-C and Nzl-D.

Figure 30:
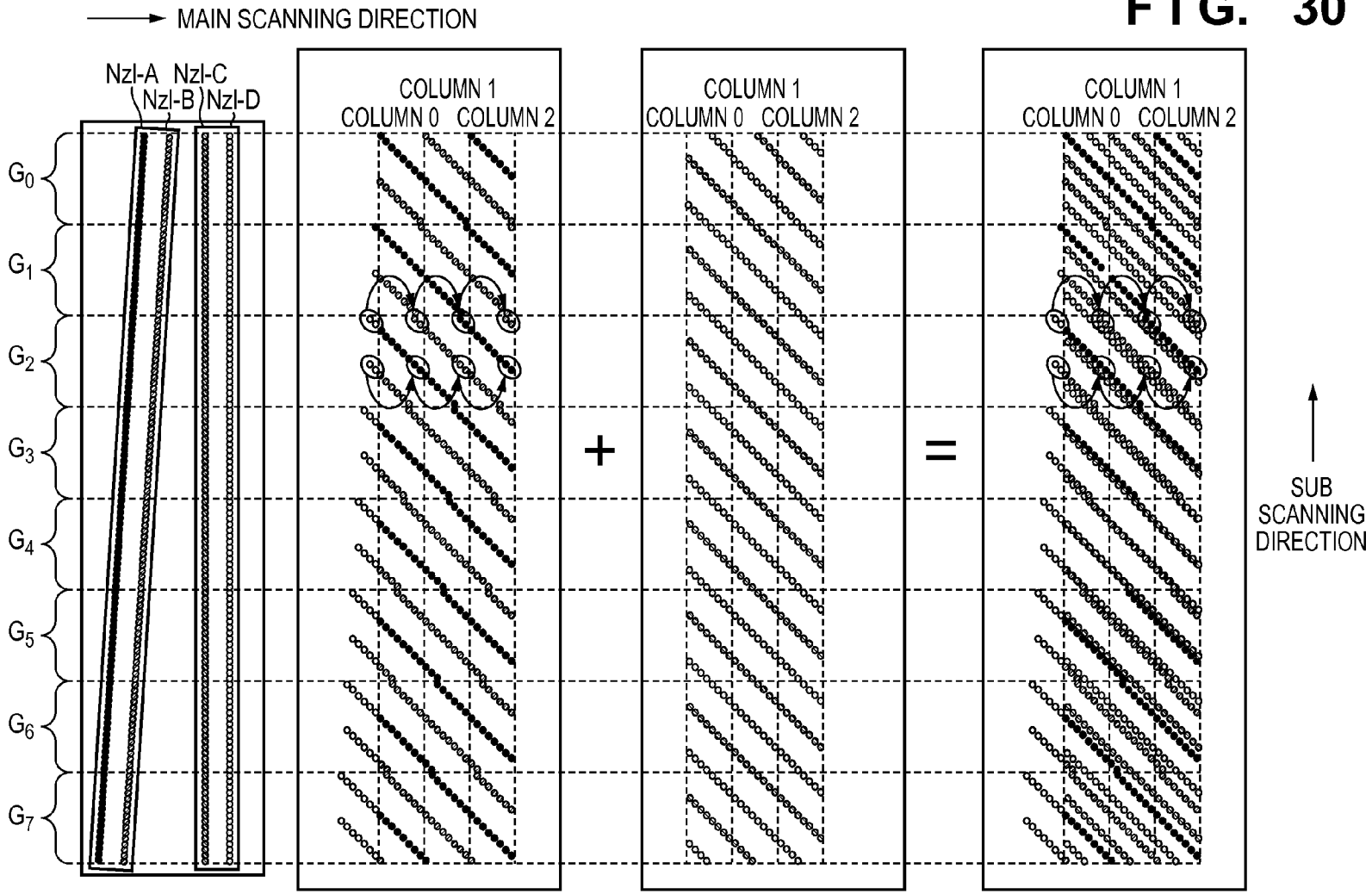
FIG. 30 is a view for explaining dots printed on a printing medium.
Figure 31:
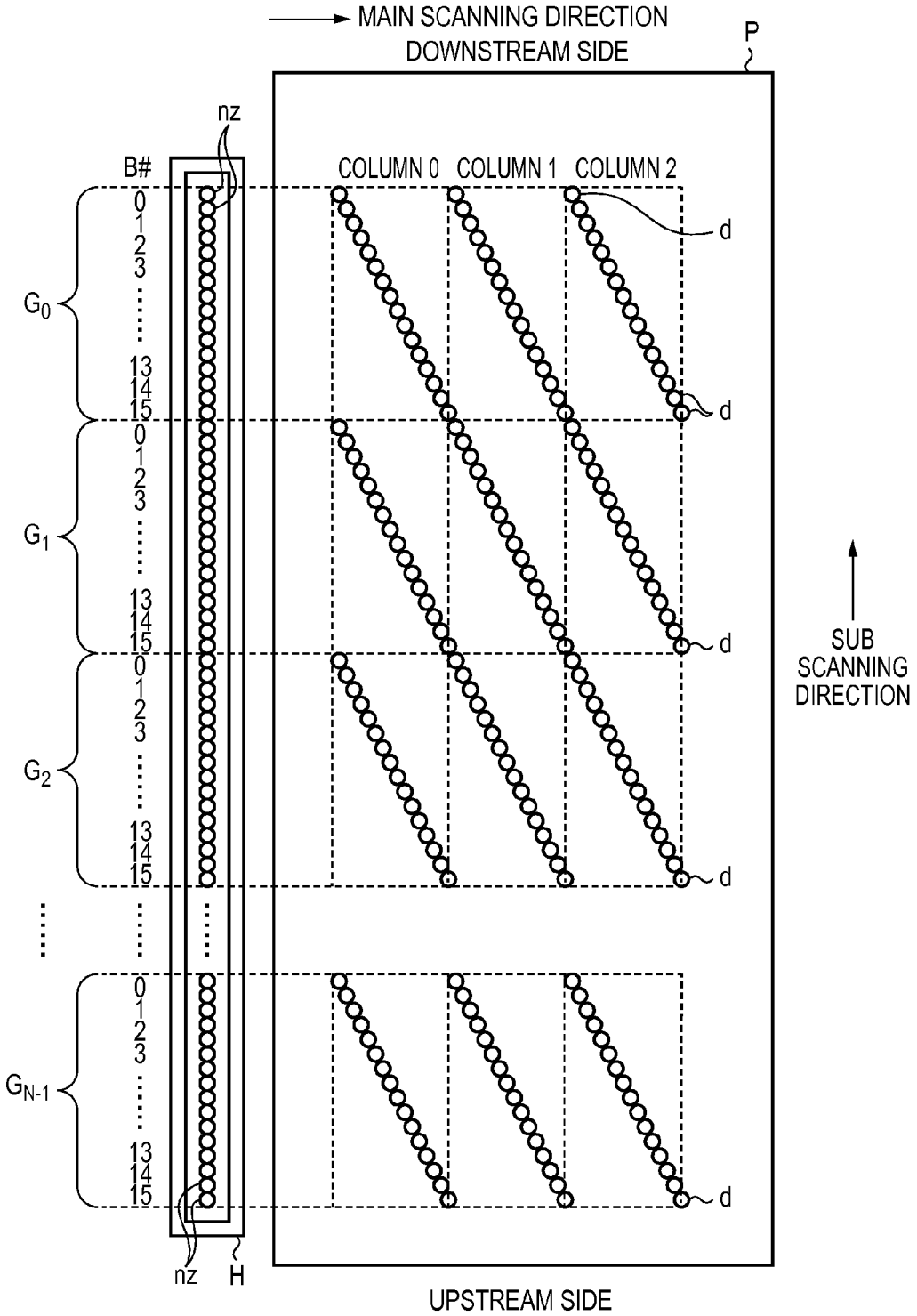
FIG. 31 is a view for explaining an example of printing using a printhead H.
Figure 32:
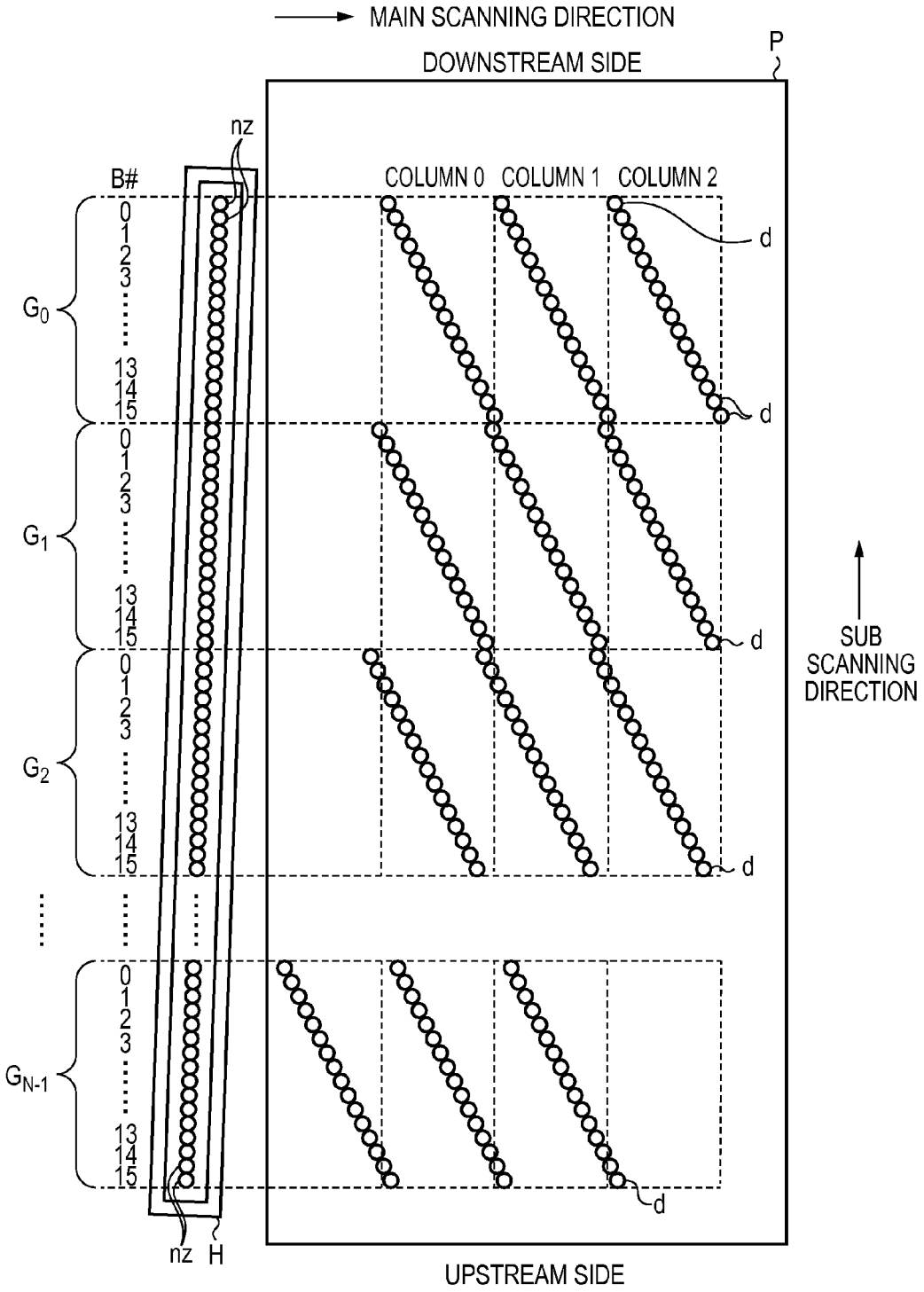
FIG. 32 is a view for explaining an example of printing when the printhead H has a tilt.

FIG. 30 is a schematic view for explaining dots printed in each column on a printing medium when printing position shift correction is performed, in the same manner as in FIG. 28. In FIG. 30, hollow dots ("○" in FIG. 30) indicate dots when no dot printing position correction is performed. When printing position correction is performed as described above, dots whose printing positions are deviated from corresponding columns when no correction is performed because the nozzle array Nzl-A and the like have a tilt are printed in the corresponding columns.

Even in the arrangement in which a plurality of nozzle arrays are formed by using two or more nozzle substrates as in this embodiment, printing position correction can be performed based on a nozzle array tilt. In this arrangement, for example, it is possible to measure a nozzle array tilt for each nozzle substrate, and perform printing position correction based on the tilt for each nozzle substrate.

As described above, this embodiment is also advantageous in correcting a printing position shift when the arrangement direction of two or more nozzle arrays has a tilt with respect to the sub scanning direction. Note that the explanation has been made by focusing on the ODD arrays in order to facilitate the explanation in this embodiment as well. However, the above-described printing position correction based on a tilt can be performed on the EVEN arrays in the same manner as that for the ODD arrays.

5. Control by Program

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

6. Others

In the above explanation, the arrangements using the inkjet printing method which performs printing by applying ink as a printing agent to a printing medium have been exemplified, and the four embodiments have been described. However, the present invention is not limited to this mode, and it is also possible to partially change the present invention and combine the above-described embodiments as needed without departing from the spirit and scope of the invention.

For example, each of the above embodiments is based on the assumption that the printhead is mounted such that the arrangement direction of the nozzle arrays is parallel to the sub scanning direction (Y direction), and the data processing method for the case in which the arrangement direction actually have a tilt with respect to the sub scanning direction is exemplified. However, the data processing method of each embodiment is also applicable even to an arrangement in which the nozzle array arrangement direction and sub scanning direction should make a predetermined angle. More specifically, these processing methods need only be performed based on a shift amount from the predetermined angle. That is, even in the arrangement in which the nozzle array arrangement direction and sub scanning direction should make a predetermined angle, the processing method exemplified in each embodiment can be performed based on a tilt of the arrangement direction with respect to the sub scanning direction.

Furthermore, the data processing methods of the embodiments can be applied to a printer which uses a printhead having nozzles arranged over the entire width of a printing medium and performs one-pass printing by conveying the printing medium in a direction perpendicular to the nozzle array arrangement direction. These processing methods need only be performed based on a shift amount from the predetermined angle in this case as well.

"Printing" includes printing for forming significant information such as characters and graphics, and also includes a broad sense of printing regardless of significance/insignificance. For example, "printing" need not mean information which is visualized so that a human can visually perceive, and can include printing which forms, for example, images, figures, patterns, and structures on printing media, and printing which processes media.

Also, a "printing agent" can include expendables to be used to perform printing, in addition to "ink" used in the above-described embodiments. For example, the "printing agent" can include a material to be used to form images, figures, patterns, and the like when applied onto a print medium, and a liquid which can process the print medium, and can process ink (for example, can solidify or insolubilize a coloring agent contained in ink applied to the print medium).

Also, the term "print medium" not only includes a paper sheet used in common printing apparatuses, but also broadly includes materials, such as cloth, a plastic film, a metal plate, glass, ceramics, wood, and leather, capable of accepting ink.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-255368, filed Dec. 10, 2013, which is hereby incorporated by reference herein in its entirety.

What is claimed is:

1. A printing apparatus comprising:

a driving unit configured to drive a printhead including a plurality of nozzles formed into an array in a predetermined direction such that each nozzle of the printhead forms a dot on a printing medium, while scanning the printhead in a first direction intersecting the predetermined direction with respect to the printing medium, wherein the plurality of nozzles are arranged such that nozzles for printing dots of the same color form two or more nozzle arrays adjacent to each other in the first direction;

a memory configured to store printing data;

a data processing unit configured to perform a first operation for developing printing data column by column on the memory, and a second operation for assigning the printing data on the memory to each nozzle array; and a controlling unit configured to control the driving unit to print dots on the printing medium by using the nozzles of each nozzle array, based on the assigned printing data, wherein the data processing unit further performs, after the first operation and before the second operation, an operation for specifying, in a case where printing is performed by assigning, to each nozzle array, the printing data of each column developed on the memory in the first operation, a portion of the printing data, which corresponds to a dot whose printing position is deviated from a region corresponding to the column of the printing data due to a tilt of the two or more nozzle arrays with respect to a direction perpendicular to the first direction, based on the tilt of the two or more nozzle arrays, and an operation for changing, on the memory, the printing data developed on the memory, such that the specified portion is shifted by a column corresponding to the tilt of the two or more nozzle arrays.

2. The apparatus according to claim 1, wherein, in the second operation, the data processing unit assigns the printing data on the memory such that nozzles arranged in the first direction in the two or more nozzle arrays are permitted to sequentially print dots.

3. The apparatus according to claim 2, wherein information for determining a use order of the nozzles of each nozzle array is stored in the memory, and the data processing unit assigns the printing data on the memory in accordance with the information in the second operation.

4. The apparatus according to claim 1, wherein in the operation of changing the printing data, the data processing unit shifts the specified portion by inserting null data into the specified portion.

5. The apparatus according to claim 1, further comprising a measuring unit configured to measure the tilt of the two or more nozzle arrays based on a first test pattern and a second test pattern printed on the printing medium, wherein the first test pattern includes two dot patterns printed by a predetermined number of nozzles in one end portion of at least one of the two or more nozzle arrays, and the second test pattern includes a dot pattern printed between the two dot patterns by the predetermined number of nozzles in the other end portion of the at least one nozzle array.

6. The apparatus according to claim 1, further comprising a measuring unit configured to measure the tilt of the two or more nozzle arrays based on a distance between a first test pattern and a second test pattern printed on the printing medium, wherein the first test pattern is printed by a predetermined number of nozzles in one end portion of at least one of the two or more nozzle arrays, and the second test pattern is printed by the predetermined number of nozzles in the other end portion of the at least one nozzle array.

7. The apparatus according to claim 1, wherein printing is performed by a time-divisional driving method.

8. A printing apparatus comprising a driving unit configured to drive a printhead including two or more nozzle substrates on each of which a plurality of nozzles are arranged such that each nozzle of the printhead prints a dot on a printing medium, and a conveying unit configured to convey the printing medium, wherein on each of the nozzle substrate, the plurality of nozzles are arranged such that nozzles for printing dots of the same color form two or more nozzle arrays adjacent to each other in parallel, the printing apparatus further comprises:

a memory configured to store printing data; and a data processing unit configured to perform, for each nozzle substrate, a first operation for developing printing data column by column on the memory, and a second operation for assigning the printing data on the memory to each nozzle array;

a controlling unit configured to control the driving unit to print dots on the printing medium by using the nozzles of each nozzle array, based on the assigned printing data, wherein, for each nozzle substrate, the data processing unit further performs, after the first operation and before the second operation, an operation for specifying, in a case where printing is performed by assigning, to each nozzle array, the printing data of each column developed on the memory by the first operation, a portion of the printing data, which corresponds to a dot whose printing position is deviated from a region corresponding to the column of the printing data due to a tilt of the two or more nozzle arrays with respect to a conveyance direction of the printing medium, based on the tilt of the two or more nozzle arrays, and an operation for changing, on the memory, the printing data developed on the memory, such that the specified portion is shifted by a column corresponding to the tilt of the two or more nozzle arrays.

9. A method for processing printing data input to a printing apparatus, the printing apparatus comprising:

a driving unit configured to drive a printhead including a plurality of nozzles such that each nozzle of the printhead prints a dot on a printing medium;

a conveying unit configured to convey the printing medium; and a memory configured to store printing data, and the plurality of nozzles being arranged such that nozzles for printing dots of the same color form two or more nozzle arrays adjacent to each other in parallel, the method for processing printing data comprising:

developing printing data column by column on the memory;

assigning the printing data on the memory to each nozzle array; and controlling the driving unit to print dots on the printing medium by using the nozzles of each nozzle array, based on the assigned printing data, and the method for processing printing data further comprising, after the developing and the assigning:

specifying, in a case where printing is performed by assigning, to each nozzle array, the printing data of each column developed on the memory in the developing, a portion of the printing data, which corresponds to a dot whose printing position is deviated from a region corresponding to the column of the printing data due to a tilt of the two or more nozzle arrays with respect to a conveyance direction of the printing medium, based on the tilt of the two or more nozzle arrays; and changing, on the memory, the printing data developed on the memory, such that the specified portion is shifted by a column corresponding to the tilt of the two or more nozzle arrays.

* * * * *